US008139021B2

(12) United States Patent
Botzas et al.

(10) Patent No.: US 8,139,021 B2
(45) Date of Patent: Mar. 20, 2012

(54) HISTOGRAM-BASED DYNAMIC BACKLIGHT CONTROL SYSTEMS AND METHODS

(75) Inventors: Anthony Botzas, San Jose, CA (US); Sarah Sunyoung Hwang, Sunnyvale, CA (US); Michael Francis Higgins, Cazadero, CA (US); Candice Hellen Brown Elliott, Santa Rosa, CA (US)

(73) Assignee: Samsung Electronics Co., Ltd. (KR)

( * ) Notice: Subject to any disclaimer, the term of this patent is extended or adjusted under 35 U.S.C. 154(b) by 970 days.

(21) Appl. No.: 12/123,414

(22) Filed: May 19, 2008

(65) Prior Publication Data

US 2009/0284457 A1 Nov. 19, 2009

(51) Int. Cl.
*G09G 3/36* (2006.01)

(52) U.S. Cl. ..... 345/102; 345/89

(58) Field of Classification Search ..... 345/89, 345/102

See application file for complete search history.

(56) References Cited

U.S. PATENT DOCUMENTS

2008/0074372 A1 * 3/2008 Baba et al. ..... 345/89

FOREIGN PATENT DOCUMENTS

| | | |
|---|---|---|
| CN | 2008-076755 | 4/2008 |
| JP | 2008-076755 | 4/2008 |
| JP | 2008-096696 | 4/2008 |
| JP | 2008096696 A * | 4/2008 |

* cited by examiner

*Primary Examiner* — Quan-Zhen Wang
*Assistant Examiner* — Troy Dalrymple
(74) *Attorney, Agent, or Firm* — Innovation Counsel LLP

(57) ABSTRACT

Displays systems and methods for adjusting backlight illumination are disclosed wherein backlight illumination may be set low enough according to an error threshold amount in order to reduce backlight power consumption while maintaining a level of image quality. In one embodiment, image data is evaluated within a given frame and partitioned into histogram bins depending on the amount of backlight illumination requested or required by the image data. The histogram is traversed to provide an accumulative error measure. The error measure is compared against the error threshold and, if exceeded, the final backlight illumination may be set as a function of various illumination levels considered and possibly the first and a second threshold.

17 Claims, 10 Drawing Sheets

HISTOGRAM-BASED DYNAMIC BACKLIGHT CONTROL SYSTEMS AND METHODS

BACKGROUND

Novel sub-pixel arrangements are disclosed for improving the cost/performance curves for image display devices in the following commonly owned United States patents and patent applications including: (1) U.S. Pat. No. 6,903,754 ("the '754 patent") entitled "ARRANGEMENT OF COLOR PIXELS FOR FULL COLOR IMAGING DEVICES WITH SIMPLIFIED ADDRESSING;" (2) United States Patent Publication No. 2003/0128225 ("the '225 application") having application Ser. No. 10/278,353 and entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") having application Ser. No. 10/278,352 and entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") having application Ser. No. 10/243,094 and entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") having application Ser. No. 10/278,328 and entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) U.S. Pat. No. 7,283,142 ("the '12 patent") having application Ser. No. 10/278,393 and entitled "COLOR DISPLAY HAVING HORIZONTAL SUB-PIXEL ARRANGEMENTS AND LAYOUTS," filed Oct. 22, 2002; and (7) United States Patent Publication No. 2004/0080479 ("the '479 application") having application Ser. No. 10/347,001 and entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003. Each of the aforementioned '225, '179, '724, '423, and '479 published applications and U.S. Pat. Nos. 6,903,754 and 7,283,142 are hereby incorporated by reference herein in its entirety.

For certain subpixel repeating groups having an even number of subpixels in a horizontal direction, systems and techniques to affect improvements, e.g. polarity inversion schemes and other improvements, are disclosed in the following commonly owned United States patent documents: (1) United States Patent Publication No. 2004/0246280 ("the '280 application") having application Ser. No. 10/456,839 and entitled "IMAGE DEGRADATION CORRECTION IN NOVEL LIQUID CRYSTAL DISPLAYS"; (2) United States Patent Publication No. 2004/0246213 ("the '213 application") (U.S. patent application Ser. No. 10/455,925) entitled "DISPLAY PANEL HAVING CROSSOVER CONNECTIONS EFFECTING DOT INVERSION"; (3) U.S. Pat. No. 7,218,301 ("the '301 patent") having application Ser. No. 10/455,931 and entitled "SYSTEM AND METHOD OF PERFORMING DOT INVERSION WITH STANDARD DRIVERS AND BACKPLANE ON NOVEL DISPLAY PANEL LAYOUTS"; (4) U.S. Pat. No. 7,209,105 ("the '105 patent") having application Ser. No. 10/455,927 and entitled "SYSTEM AND METHOD FOR COMPENSATING FOR VISUAL EFFECTS UPON PANELS HAVING FIXED PATTERN NOISE WITH REDUCED QUANTIZATION ERROR"; (5) U.S. Pat. No. 7,187,353 ("the '353 patent") having application Ser. No. 10/456,806 entitled "DOT INVERSION ON NOVEL DISPLAY PANEL LAYOUTS WITH EXTRA DRIVERS"; (6) United States Patent Publication No. 2004/0246404 ("the '404 application") having application Ser. No. 10/456,838 and entitled "LIQUID CRYSTAL DISPLAY BACKPLANE LAYOUTS AND ADDRESSING FOR NON-STANDARD SUBPIXEL ARRANGEMENTS"; (7) United States Patent Publication No. 2005/0083277 ("the '277 application") having application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) U.S. Pat. No. 7,268,758 ("the '758 patent") having application Ser. No. 10/807,604 and entitled "IMPROVED TRANSISTOR BACKPLANES FOR LIQUID CRYSTAL DISPLAYS COMPRISING DIFFERENT SIZED SUBPIXELS", filed Mar. 23, 2004. Each of the aforementioned '280, '213, '404, and '277 published applications and the '353, '301, '105 and '758 patents are hereby incorporated by reference herein in its entirety.

These improvements are particularly pronounced when coupled with sub-pixel rendering (SPR) systems and methods further disclosed in the above-referenced U.S. Patent documents and in commonly owned United States patents and patent applications: (1) U.S. Pat. No. 7,123,277 ("the '277 patent") having application Ser. No. 10/051,612 and entitled "CONVERSION OF A SUB-PIXEL FORMAT DATA TO ANOTHER SUB-PIXEL DATA FORMAT," filed Jan. 16, 2002; (2) U.S. Pat. No. 7,221,381 ("the '381 patent") having application Ser. No. 10/150,355 entitled "METHODS AND SYSTEMS FOR SUB-PIXEL RENDERING WITH GAMMA ADJUSTMENT," filed May 17, 2002; (3) U.S. Pat. No. 7,184,066 ("the '066 patent") having application Ser. No. 10/215,843 and entitled "METHODS AND SYSTEMS FOR SUB-PIXEL RENDERING WITH ADAPTIVE FILTERING," filed Aug. 8, 2002; (4) United States Publication No. 2004/0196302 ("the '302 application") having application Ser. No. 10/379,767 and entitled "SYSTEMS AND METHODS FOR TEMPORAL SUB-PIXEL RENDERING OF IMAGE DATA" filed Mar. 4, 2003; (5) U.S. Pat. No. 7,167,186 ("the '186 patent") having application Ser. No. 10/379,765 and entitled "SYSTEMS AND METHODS FOR MOTION ADAPTIVE FILTERING," filed Mar. 4, 2003; (6) U.S. Pat. No. 6,917,368 ("the '368 patent") entitled "SUB-PIXEL RENDERING SYSTEM AND METHOD FOR IMPROVED DISPLAY VIEWING ANGLES"; and (7) U.S. Pat. No. 7,352,374 ("the '374 patent") having application Ser. No. 10/409,413 and entitled "IMAGE DATA SET WITH EMBEDDED PRE-SUBPIXEL RENDERED IMAGE" filed Apr. 7, 2003. Each of the aforementioned '302 application and the '277, '381, '066, '186, '368 and the '374 patents are hereby incorporated by reference herein in its entirety.

Improvements in gamut conversion and mapping are disclosed in commonly owned United States patents and copending United States patent applications: (1) U.S. Pat. No. 6,980,219 ("the '219 patent") entitled "HUE ANGLE CALCULATION SYSTEM AND METHODS"; (2) United States Patent Publication No. 2005/0083341 ("the '341 application") having application Ser. No. 10/691,377 and entitled "METHOD AND APPARATUS FOR CONVERTING FROM SOURCE COLOR SPACE TO TARGET COLOR SPACE", filed Oct. 21, 2003; (3) United States Patent Publication No. 2005/0083352 ("the '352 application") having application Ser. No. 10/691,396 and entitled "METHOD AND APPARATUS FOR CONVERTING FROM A SOURCE COLOR SPACE TO A TARGET COLOR SPACE", filed Oct. 21, 2003; (4) U.S. Pat. No. 7,176,935 ("the '935 patent") having application Ser. No. 10/690,716 and entitled "GAMUT CONVERSION SYSTEM AND METHODS" filed Oct. 21, 2003. Each of the aforementioned '341, and '352 applications and the '219 and '935 patents is hereby incorporated by reference herein in its entirety.

Additional advantages have been described in (1) U.S. Pat. No. 7,084,923 ("the '923 patent") having application Ser. No. 10/696,235 and entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and in (2) United States Patent Publication No. 2005/0088385 ("the '385 application") having application Ser. No. 10/696,026 and entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003, each of which is hereby incorporated herein by reference in its entirety.

Additionally, each of these co-owned and co-pending applications is herein incorporated by reference in its entirety: (1) United States Patent Publication No. 2005/0225548 ("the '548 application") having application Ser. No. 10/821,387 and entitled "SYSTEM AND METHOD FOR IMPROVING SUB-PIXEL RENDERING OF IMAGE DATA IN NON-STRIPED DISPLAY SYSTEMS"; (2) U.S. Pat. No. 7,301,543 ("the '543 patent") having application Ser. No. 10/821,386 and entitled "SYSTEMS AND METHODS FOR SELECTING A WHITE POINT FOR IMAGE DISPLAYS"; (3) United States Patent Publication No. 2005/0225574 ("the '574 application") and United States Patent Publication No. 2005/0225575 ("the '575 application") having application Ser. Nos. 10/821,353 and 10/961,506 respectively, and both entitled "NOVEL SUBPIXEL LAYOUTS AND ARRANGEMENTS FOR HIGH BRIGHTNESS DISPLAYS"; (4) United States Patent Publication No. 2005/0225562 ("the '562 application") having application Ser. No. 10/821,306 and entitled "SYSTEMS AND METHODS FOR IMPROVED GAMUT MAPPING FROM ONE IMAGE DATA SET TO ANOTHER"; (5) U.S. Pat. No. 7,248,268 ("the '268 patent") having application Ser. No. 10/821,388 and entitled "IMPROVED SUBPIXEL RENDERING FILTERS FOR HIGH BRIGHTNESS SUBPIXEL LAYOUTS"; and (6) United States Patent Publication No. 2005/0276502 ("the '502 application") having application Ser. No. 10/866,447 and entitled "INCREASING GAMMA ACCURACY IN QUANTIZED DISPLAY SYSTEMS."

Additional improvements to, and embodiments of, display systems and methods of operation thereof are described in: (1) Patent Cooperation Treaty (PCT) Application No. PCT/US 06/12768, entitled "EFFICIENT MEMORY STRUCTURE FOR DISPLAY SYSTEM WITH NOVEL SUBPIXEL STRUCTURES" filed Apr. 4, 2006, and published in the United States as United States Patent Application Publication 2008/0170083; (2) Patent Cooperation Treaty (PCT) Application No. PCT/US 06/12766, entitled "SYSTEMS AND METHODS FOR IMPLEMENTING LOW-COST GAMUT MAPPING ALGORITHMS" filed Apr. 4, 2006, and published in the United States as United States Patent Application Publication 2008/0150958; (3) United States Patent Publication No. 2006/0244686 ("the '686 application") having application Ser. No. 11/278,675 and entitled "SYSTEMS AND METHODS FOR IMPLEMENTING IMPROVED GAMUT MAPPING ALGORITHMS" filed Apr. 4, 2006, and published as United States Patent Application Publication 2006/0244686 ("the '686 application"); (4) Patent Cooperation Treaty (PCT) Application No. PCT/US 06/12521, entitled "PRE-SUBPIXEL RENDERED IMAGE PROCESSING IN DISPLAY SYSTEMS" filed Apr. 4, 2006, and published in the United States as United States Patent Application Publication 2006/0244686; and (5) Patent Cooperation Treaty (PCT) Application No. PCT/US 06/19657, entitled "MULTIPRIMARY COLOR SUBPIXEL RENDERING WITH METAMERIC FILTERING" filed on May 19, 2006 and published in the United States as United States Patent Application Publication 2009/0058873 (referred to below as the "Metamer Filtering application".) Each of these co-owned applications is also herein incorporated by reference in their entirety.

Additional improvements to, and embodiments of, display systems and methods of operation thereof are described in: (1) Patent Cooperation Treaty (PCT) Application No. PCT/US 06/40272, entitled "IMPROVED GAMUT MAPPING AND SUBPIXEL RENDERING SYSTEMS AND METHODS" filed Oct. 13, 2006, and published in the United States as United States Patent Application Publication 2009/0122073; (2) Patent Cooperation Treaty (PCT) Application No. PCT/US 06/40269, entitled "IMPROVED MEMORY STRUCTURES FOR IMAGE PROCESSING" filed Oct. 13, 2006, and published in the United States as United States Patent Application Publication 2010/0026704; (3) Patent Cooperation Treaty (PCT) Application No. PCT/US 07/068885, entitled "HIGH DYNAMIC CONTRAST SYSTEM HAVING MULTIPLE SEGMENTED BACKLIGHT" filed on May 14, 2007 and published in the United States as United States Patent Application Publication 2009/0174638; (4) Patent Cooperation Treaty (PCT) Application No. PCT/US 07/069933, entitled "MULTIPRIMARY COLOR DISPLAY WITH DYNAMIC GAMUT MAPPING" filed on May 30, 2007 and published in the United States as United States Patent Application Publication 2007/0279372; and (5) Patent Cooperation Treaty (PCT) Application No. PCT/US 07/079408, entitled "SYSTEMS AND METHODS FOR REDUCING DESATURATION OF IMAGES RENDERED ON HIGH BRIGHTNESS DISPLAYS" filed on Sep. 25, 2007 and published in the United States as United States Patent Application Publication 2010/0026705; and (6) Patent Cooperation Treaty (PCT) Application No. PCT/US 08/053450, entitled "SUBPIXEL LAYOUTS AND SUBPIXEL RENDERING METHODS FOR DIRECTIONAL DISPLAYS AND SYSTEMS" filed on Feb. 8, 2008 and published in the United States as United States Patent Application Publication 2010/0118045; and (7) Patent Cooperation Treaty (PCT) Application No. PCT/US 08/56241, entitled "SUBPIXEL LAYOUTS FOR HIGH BRIGHTNESS DISPLAYS AND SYSTEMS" filed on Mar. 7, 2008 and published in the United States as United States Patent Application Publication 2008/0049047; and (8) Patent Cooperation Treaty (PCT) Application No. PCT/US 08/60515, entitled "SUBPIXEL RENDERING AREA RESAMPLE FUNCTIONS FOR DISPLAY DEVICES" filed on Apr. 20, 2008 and published in the United States as United States Patent Application Publication 2010/0045695; and (9) Patent Cooperation Treaty (PCT) Application No. PCT/US 08/61906, entitled "IMAGE DOLOR BALANCE ADJUSTMENT FOR DISPLAY PANELS WITH 2D SUBPIXEL LAYOUTS" filed on Apr. 29, 2008 and published in the United States as United States Patent Application Publication 2010/0149204; and (10) Patent Cooperation Treaty (PCT) U.S. Application Ser. No. 60/978,737, entitled "SYSTEMS AND METHODS FOR SELECTIVE HANDLING OF OUT-OF- GAMUT COLOR CONVERSIONS" and published in the United States as United States Patent Application Publication 2009/0092325; and (11) U.S. Application Ser. No. 60/981,355, entitled "ADAPTIVE BACKLIGHT CONTROL DAMPENING TO REDUCE FLICKER" and published in the United States as United States Patent Application Publication 2009/0102783. Each of these co-owned applications is also herein incorporated by reference in their entirety.

DETAILED DESCRIPTION

Novel Displays Having Dynamic Backlight Control (DBLC)

Many new display panel systems utilize some form of Dynamic Backlight Control (DBLC) function. This function allows for control over power usage and image quality. Along with the ability to change the backlight level comes the critical need to adjust it and other display parameters intelligently to avoid causing bothersome artifacts to image quality.

Most display manufacturers are concerned about the display panel's increasing share of the power consumption budget on platforms, such as mobile cell phones. As such, display manufacturers are seeking to reduce the backlight consumption of power in all display modules, including legacy RGB stripe systems. While the techniques described herein apply to such legacy RGB stripe systems, they also apply to newer systems having multiprimary panels (e.g. RGBW) that have more—and possibly different—colored filters than red, green and blue. Such systems in fact exhibit an extra degree of freedom when considering the optimal manner of displaying a given image upon a screen that minimizes power consumption of the backlight—while at the same time minimizes any visual error noticeable to the user that might be induced from lowering backlight power.

Of course, if the backlight power is always at 100%, then no error would be introduced as a result of control of the backlight. If backlight power is reduced by 50%, then it is not hard to create images—e.g. having areas of bright saturated color—that may have visual error and artifacts that are noticeable to the user. As image rendering control methodologies rely on an intelligent mix of control of the light valve and the amount of backlight power to render images upon a display screen, it may be desirable to consider a statistical approach based on the spread of brightness "needs" of individual pixels within a frame to make decisions as to how to optimally set backlight power for a given frame or frames of image data.

Figure 1:
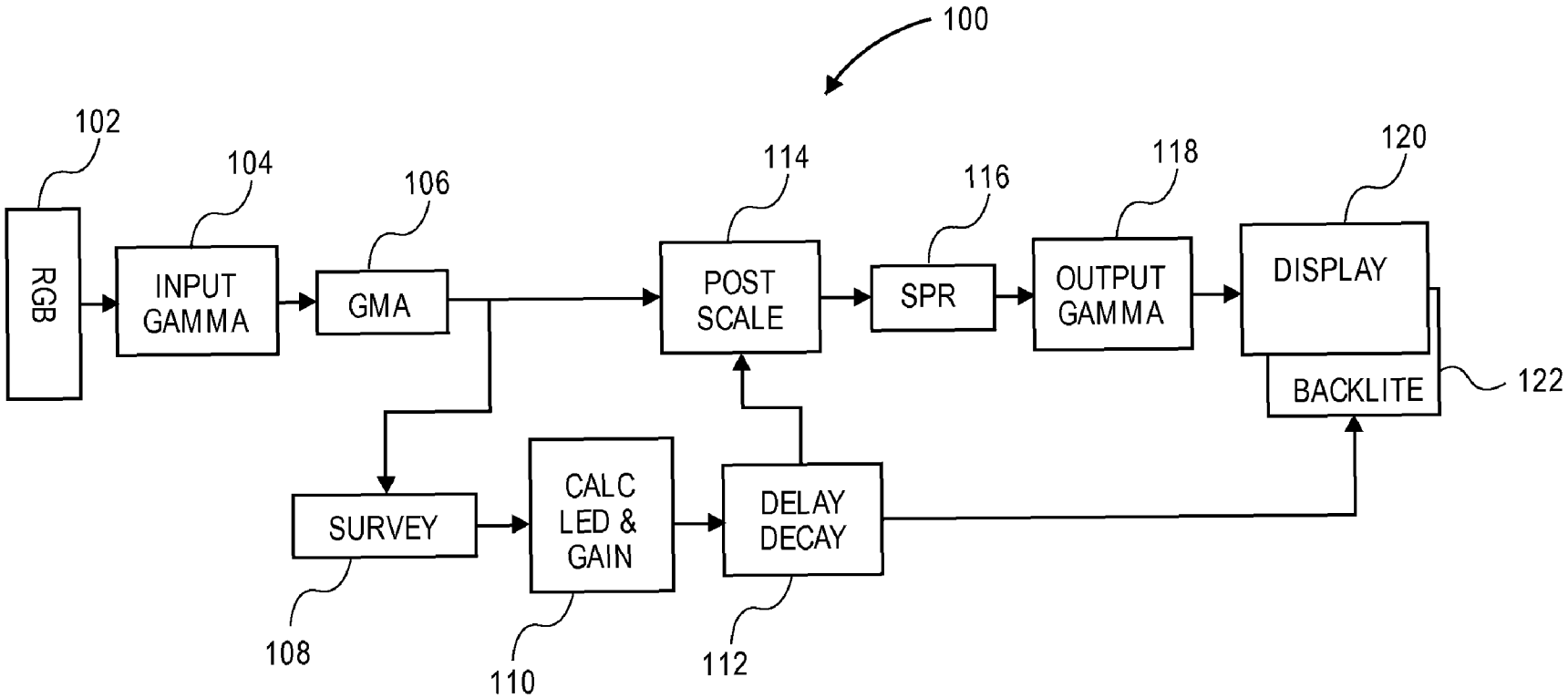
FIG. 1 is one embodiment of a display system made in accordance with the present invention.

FIG. 1 shows one embodiment of a display system 100 in which the techniques of the present application may be applied. Interface 102 to the display system could be employed to input image data or generate such image data. Optional input gamma block 104 could be employed in the display system, particularly if the display is of technology that needs to adjust for gamma—e.g. LCD displays. Image data may take two paths—one for control of the backlight and one for control of the display. Image Survey 108 may gather certain image data statistics to determine whether a present frame (or portion thereof) is part of a same or similar scene or represents a change in scenes that might require a large change in the backlight illumination.

Calc LED and gain function block 110 could be employed to determine a target backlight illumination for the given frame (or portion thereof) and determine a smoothing function (from perhaps a set of suitable functions) to change the illumination of the backlight from a current value to the target value in such a way as to minimize visual artifacts. Delay/Decay block 112 could provide further control of backlight signals. Such further control may be fed to both the backlight 122 and to a post-scale block 114, as will be discussed further.

Backlight illumination signals from block 112 are then employed to drive backlight 122. It should be appreciated that backlight 122 may be anyone of many different types of backlights available—e.g. LED backlights, CCFL backlights or the like. The backlight could also be constructed in any known configuration—e.g. a 2-D array of individual emitters or a set of edge lit emitters or any other known configuration.

Image data may also be processed in an imaging pipeline, starting with Input Gamma block 104, as discussed below. GMA 106 may provide gamut mapping from one source color space to a target color space—if such function is needed, for example, if the input color data is RGB and the display 120 is comprises a multiprimary or RGBW layout. Post color conversion processing may be provided by Post Scale block 114, as will be discussed further below. If the data is to be subpixel rendered onto the display, then block 106 may comprise an optional subpixel rendering processing (SPR) block. Such may be the case if the display comprises any one of a novel subpixel repeating group, as is detailed in many of the patent applications described above. SPR processing is discussed in many of the above mentioned patent applications that are incorporated by reference. Finally, image data may be processed in an optional output gamma block 118 before the signals are sent to display 120—e.g. to drive individual subpixels upon display 120.

Although the present inventions herein will be described herein principally as they applies to RGBW display systems, it will be appreciated that the systems and techniques of the present invention apply as well to multiprimary systems (e.g. RGBY, RGBC, CMYW, etc.) with suitable adjustments. Many of these systems may input legacy RGB image data and perform gamut mapping (GMA) operations onto these multiprimary displays (e.g. RGB to RGBW mapping). Many of these systems may make use of subpixel rendering (SPR) techniques (e.g. particularly on novel subpixel layouts as developed by ClairVoyante) that offer opportunities to enhance visual resolution. It will also be appreciated that the techniques of the present invention does not rely on the use of GMA or SPR processing necessarily—the present techniques also work with conventional RGB stripe display systems that do not have GMA or SPR. It will be understood, however, that the present techniques may work well with such advanced multiprimary systems and may offer benefit over and above what may be possible with such legacy RGB stripe displays.

Input Gamma Dithering

A refinement to conventional display systems may occur early in the image pipeline—as early as input gamma processing. The exemplary display system 100 may start processing input image data with Input Gamma 104. As is known, input gamma processing may be employed to linearize the input image data 202, often with an input gamma LUT. However, display systems often introduce quantization error when doing calculations on the data flowing through the pipeline. Introducing some dithering on the input side of the pipeline may decrease the quantization error. In a system with SPR (in particular with area resampling as disclosed in the '612 application), patterned input dithering may be substantially filtered out, resulting in decreased quantization noise with no side effects.

Figure 2:
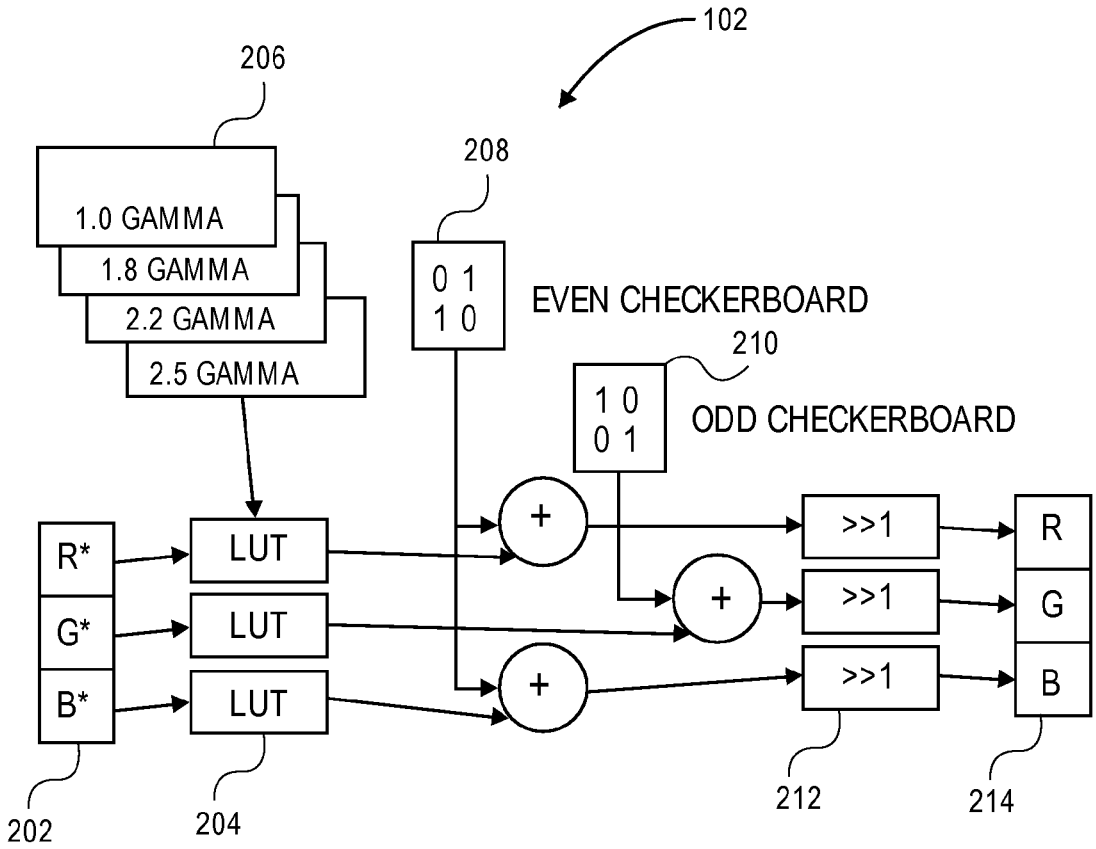
FIG. 2 is one embodiment of an input gamma dithering module.

Referring to FIG. 2, it is possible to process multiple gamma curves—in this case, 4 input gamma curves with power coefficients of 1.0, 1.8, 2.2 and 2.5 processed by the respective tables 206, loaded in to LUTs 204. Alternatively, the 1.0 table may be replaced with a mux (not shown) to select the input into the upper bits and zeros into the lower bits.

A trade-off exists in the bit depth of the processing pipeline after Input Gamma linearization of non-unity gamma curves. The greater the bit depth, the more accurately the linear data may be represented. Of course, this may incur added cost in gates and chip area to accommodate such gates. But a special problem exists in the very dark region. It is common practice to use a linear section in the dark (low values) that has a very low slope, to allow for monotonic representation of the dark values. The lower the bit depth of the post-Input Gamma processing pipeline, the longer (higher) the linear portion should be to maintain one-to-one mapping and monotonic representation. This may cause the values in the linear section to be higher than desired—brightening the dark, non-zero portions of images and reducing contrast. When a high bit depth is used to represent the values, the linear section may be made shorter, lower slope, darker, thus maintaining higher contrast.

Another choice may be to choose to maintain contrast and accuracy at the expense of loss of one-to-one, by introducing quantization by choosing to map two or more input values to the same output values in the Input Gamma function or table. This non-one-to-one mapping may introduce visible artifacts in the darker region of an image. This trade-off may be avoided using a deeper bit depth in the Input Gamma function or table, followed by a dithered quantization to a lower bit depth. For each gamma power curve, the table may store one extra output bit, one bit greater than then the post-Input Gamma processing pipeline, which may be used to accomplish a dithering (e.g. spatially dithered). A dithered value retains much of the original accuracy while allowing a lower bit depth in the subsequent processing pipeline.

Such dithering may be accomplished according to simple checkerboard patterns—e.g. 208 and 210. In one embodiment, there may be one table for each power curve and the same curve may be used on R G and B, or whatever the input data format happens to be. As this may use separate address decoders and possibly separate tables for R G and B, there may be separate memories for R G and B. If this turns out to be the case, and it does not add gates to allow the R G and B tables to have separate values, then it may be possible to use this to do white point adjustments. If there are separate tables for each color (or a subset of color), then the possibility that the three tables might be different might allow the use of them to make adjustment to the white point setting. Thus, this may allow the system to correct, for example, the blue tint of an LED backlight and make white in the image look warmer.

The dither checkerboard pattern may be calculated from the lower bits of the x and y position of the input pixel. A dither may land on input pixels that ultimately result in the same phase of the particular subpixel layout of the display—for example, the RG/BW checkerboard as disclosed in the '574 and the '575 application which are incorporated by reference above. To prevent this from happening, it is possible to dither the input R and B values on one phase of the checkerboard, and the G values on the opposite phase, as may be seen in FIG. 2. Of course, it may be desirable to have different dithering patterns depending upon the subpixel layout of the display panel and to have different dithering patterns for one or more colors to prevent such phase relationship.

In the embodiment at issue, the R*G*B* values return 12 bit values from the LUTs. The even/odd checkerboard bits are generated by exclusive ORing the lower bits of the x and y position. These checkerboard bits are added to 12 bit values, sometimes causing the lower bit to overflow into the next bit of precision. This addition (increment) can sometimes cause integer overflow. This must be checked for and the results clamped to 12 bits. The 12 bit values are truncated to 11 bits by dropping the lower bit. These 11 bit values are the output from the input gamma module.

Histogram-Based DBLC

Another refinement on conventional displays may occur in manner in which dynamic backlight control (DBLC) functions upon image data. To take one exemplary RGBW system, a system having a GMA will typically have a RGB to RGBW gamut mapping algorithms that converts white and desaturated colors to RGBW values that fall within a valid range (0% to 100%). Assuming that the transmissivity of a RGBW system (or other multiprimary displays) may be twice that of an RGB stripe reference system, only 50% backlight power may be required to represent such desaturated colors in many or most instances.

However, input RGB colors that are highly saturated are mapped to RGBW values that exceed 100% making such values invalid or "out of gamut". Pure colors typically map to RGBW values where at least one of the color channels reaches 200%. To properly render such pure colors, the data may be simultaneously scaled down by 50% to reach the valid data range and the backlight power may be doubled to 100%. This simultaneous scaling down of data values (which translates into the degree of transmissivity of the light valve) and scaling up of backlight values is how the DBLC system and algorithm reconstructs and renders colors accurately; the algorithm always aims to generate valid data values and to adjust the backlight level so as to maintain accurate luminance values.

If the algorithm were to always scale the data values down by 50% and were to always scale up the backlight to 100%, all colors would be accurately rendered but there would not be any power savings benefit. In order to save backlight energy, the DBLC may aim to survey the RGBW data values of all pixels in a frame and then determine the lowest backlight level (and the largest data scale factor) to accurately render even the worst case colors in that frame. Generally when bright pure colors such as bright yellows, are present in the frame, the backlight level may tend to approach 100%. When bright whites and bright desaturated colors are present, the backlight level may tend to approach 50%. When dark desaturated colors are present, the backlight level may tend to dip below 50%.

In one embodiment, the DBLC may be thought of as consisting of two parts: the first part is to survey or gather statistics on the backlight requirements of all pixels in the current frame, and the second part is to make a backlight decision and appropriately scale the data values consistent with that decision. As will be discussed next, the survey effectively populates a histogram data structure and then a backlight decision is made by traversing the histogram data structure.

Survey and Histogram Generation

In one embodiment of the present system, image data statistics are taken on a frame-by-frame basis. It will be appreciated that such image data statistics may be derived at anywhere within the image processing system. As such, image data statistics may be taken off of the input image data—whether that input image data is legacy converged RGB data or data in any other format. Additionally, the present system may take the statistics off of any optional post-GMA image data—for example, image data that has been mapped e.g. from RGB to RGBW. Further, the statistics may be taken off of image data that has been (optionally) SPR filtered for rendering onto the display. The scope of the present invention should not be limited to the exact placement of the statistics and/or survey processing block.

For merely some examples, performing the survey on the input data may require fewer gates because there may be fewer input primaries (e.g. 3 for RGB vs. 4 for RGBW). Alternatively, performing the survey after the GMA may require fewer gates because some of the calculations necessary for the survey may have already been performed. Alternatively, performing the survey after the SPR module may allow DBLC to be used in a system that only updates a portion of the display at a time.

In one embodiment, one convenient structure for analyzing image data may be in the form of a histogram. It will be appreciated that any other known data structure may be suitable for the purposes of controlling the backlight and light valve system and that the scope of the present invention should not be so limited to a histogram or the particular form and use of the histogram as presently discussed.

As image data is input and processed, the display system may gather statistics in survey 108 (of course, the placement of survey 108 may vary in any given display system, as discussed above). As each pixel image is considered, such pixel may be counted (or otherwise processed) in a "bin"—wherein such bin counts and/or processes like pixels.

Figure 3A:
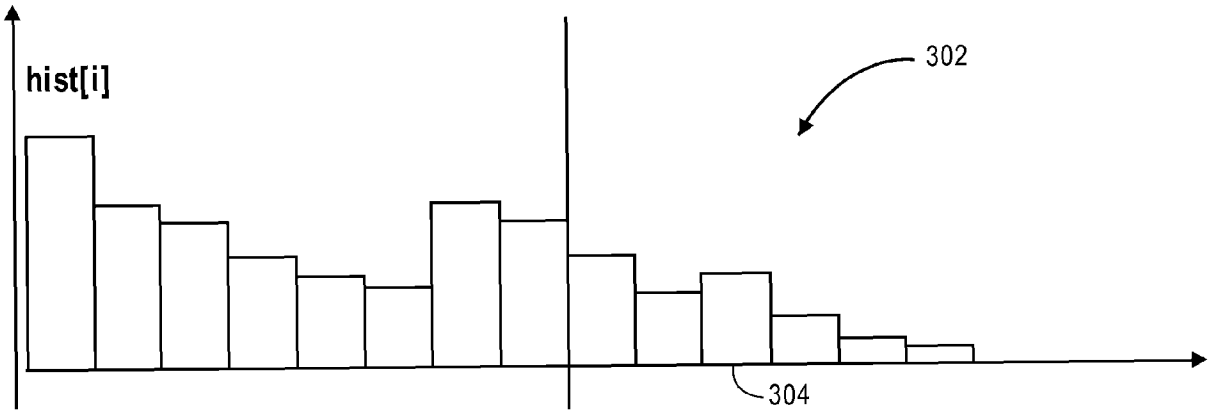
FIG. 3A shows the diagram of an exemplary histogram plot of backlight requirements of exemplary image data versus a bin count of such exemplary image data.

One example of such a histograms and a collection of bins for a putative frame of image data may be seen in FIG. 3A. FIG. 3A is a plot of bin count vs. backlight requested on the y- and x-axis respectively. Generally speaking, image data may be analyzed on a pixel by pixel basis. A determination may then be made as to what level of backlight illumination requested (or required) by such a pixel. In the case, for example, of a fully red pixel value (i.e. R=255, G=B=0), then such a fully red pixel would request/require that the backlight be fully-on. If the backlight were not fully-on, then there would be some error in the reproduction of this fully red pixel data on the display.

As noted in FIG. 3A, the bin on the x-axis furthest away from the origin would be bin where the backlight at 100% is requested. Such a fully red pixel data would increment the bin counter by one—and that bin would keep the count of the number of image data values requiring the backlight at 100%. Although it will be noted that there are shown 16 different bins, that the number of possible bins is variable. In fact, if the backlight has a discrete number of illumination values (e.g. 256), there could be as many bins as discrete illumination levels (256 bins).

For additional embodiments, the counters for the bins could be capped at a certain level (and not provide a full count of all possible image data values in a frame). For example, supposing the display in question is a VGA screen having over 300K image data values, then for a histogram having e.g. 16 bins, then each bin could be capped at some number (for example, 16K values) before throwing away any additional image data points at that value. As 16K is approximately 5% of the total number of image data values in the total frame for VGA, this may be enough data to make an intelligent selection of backlight values and light valve values.

Referring back to FIG. 3A, a histogram array, hist[i], may be created where the index, i, is proportional to the backlight level requirement and subdivides the backlight range into, in one embodiment, a series of non-overlapping categories or "backlight bins". Hence each element, hist[i], aims to store a value proportional to the number of pixels in the given frame that fall within the range of the ith backlight bin.

In order to fill the bins, a metric that correlates a given pixel value to a backlight illumination value may be used. In one such metric embodiment, the minimum backlight requirement, BL_req, for a pixel being displayed may be considered as proportional to the maximum of its component R,G,B,W values. The channel with the largest value dictates the backlight requirement as follows:

For merely one example, in linear RGBW space could be set as follows:

$$BL_req = \max(R,G,B,W)/2$$

As each pixel in a given frame is processed, the minimum backlight requirement of each pixel may be calculated and used to select the appropriate backlight bin and to increment the count value of that bin as follows:

$$\text{backlight bin } i = (BL_req/\text{maximum backlight value})^* \text{(total number of bins)}$$

If current pixel falls within category defined by backlight bin i, increment count value of that backlight bin $$hist[i] = hist[i] + 1$$

As discussed above, each counter for a given bin could be uncapped, or capped at a certain value that gives a meaningful measure of the backlight requirements of the current image to be displayed. In one embodiment, a cap range of 2-5% of the total number of pixels in an image may be reasonable. Of course, other caps are possible.

Although BL_req equation above gives one exemplary measure of the backlight requirement for a given pixel, other measures are possible. For another embodiment, it is possible to apply color weighting terms—either prior to calculating the backlight requirement based on a measure (such as max (R,G,B,W)/2) or afterwards. For example, the color channels data R,G,B,W may be individually be multiplied by color weighting terms, RWT, GWT, and BWT, consisting of values, e.g. less than 1, so that the backlight requirement of pure colors can be reduced to less than 100%. Of course, this may result in some intentional color luminance drop, yet color weighting may be considered an alternative feature in tuning the DBLC system and algorithm toward more or less aggressive power savings, as is desired.

For example, errors in displaying blue are often difficult for the human visual system to detect. Setting the BWT value to 50% may allow the backlight to drop 50% lower than necessary to correctly display blue pixels. The blue values may then need to be scaled or desaturated to bring them back into gamut but in the case of blue this error may not be very apparent in blue. Red and Green may be scaled by less, by numbers closer to 100%, without introducing unacceptable error.

Moreover, other color (e.g. yellow, magenta, or cyan) weighting term (e.g. YWT, MWT, CWT respectively) may be used to act more or less conservatively, as desired. For example, yellow—which is the brightest of all pure colors and most susceptible to perceived luminance error—may be used to be more conservative. A yellow weight may serve to further raise the value of the red weight and thus raise the backlight requirement when both bright red and bright green are present. As another alternative, a white weighting term, WWT, may be included and may typically be set to unity but may be adjusted to slightly less than 1 for aggressive settings that may allow some loss in peak white luminance in order to achieve backlight levels less than 50%. Thus, in one embodiment, the resulting color weighting expressions (given in linear RGBW space) and backlight requirement calculation may be as follows:

$$R=R*(RWT+(YWT-RWT)*G) \text{ (where } YWT>=RWT)$$

$$G=G*GWT$$

$$B=B*BWT$$

$$W=W*WWT$$

$$BL_\text{req}=\max(R,G,B,W)/2$$

Histogram Traversal and Backlight Decision

Once the histogram (or other suitable data structure) has been completed for the current image frame, the DBLC system may use this structure and data therein to intelligently set a backlight illumination that seeks the goal of minimizing backlight power consumption, while minimizing the amount of image rendering error that is at least acceptable to users. In one embodiment, the bins that represent the highest backlight power requirements may be analyzed first to determine if the backlight power can be reduced to a level lower than maximum without significantly jeopardizing the backlight needs of the majority of the pixels in the image frame. Of course, it would be understood that the order of processing the bins or the data structure may be changed without departing from the scope of the present invention.

During the course of processing the data in the histogram, it may be possible to maintain an error measure that may be used to end further processing when the error measure has reached some possible threshold or thresholds. Such threshold(s) may be determined heuristically according to some rules of human vision or empirically by polling users viewing images with varying backlight illumination.

Figure 3B:
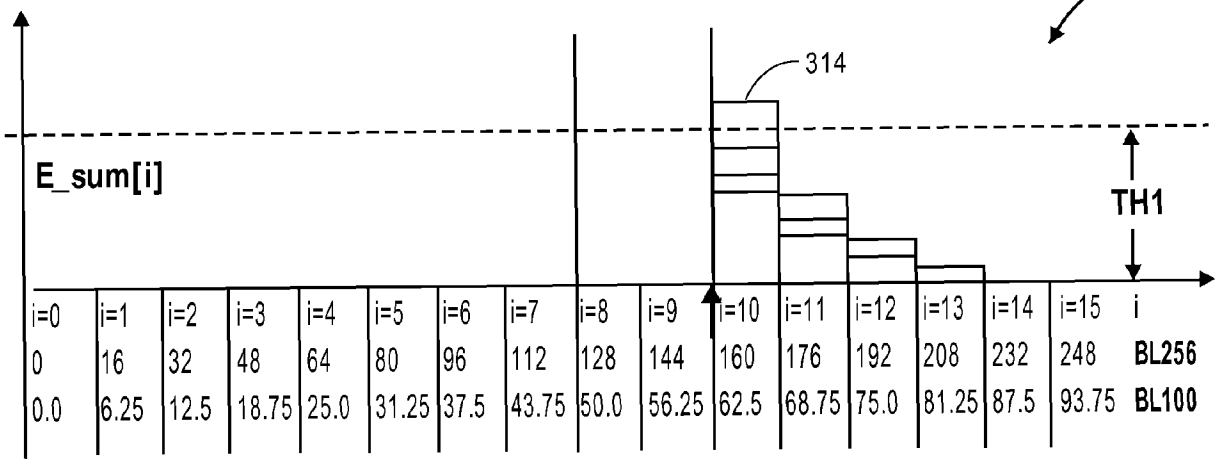
FIG. 3B depicts one embodiment of the processing of a dynamic backlight control module to find an acceptable backlight power setting that seeks to maximize power savings while remaining with acceptable visual error induced by such savings.

In one embodiment, the histogram count values may be used to create an error function, E_sum, such as seen in FIG. 3B, which may used in accumulating the amount of perceived luminance error that might be introduced if one were to progressively disregard the backlight power requirements of each power bin starting, for example, from the bin representing the highest backlight power requirement category and continuing through to the bin representing the lowest backlight power requirement category. Alternatively, an accumulation of reducing error could be maintained and processed from the bin of least backlight power requirement and continuing to highest until the error is reduced below a certain threshold.

In the case of backwards traversal from the highest power requirement bin of the histogram, if the perceived accumulated error, E_sum[i], associated with hist[i] exceeds an acceptable error threshold, TH1, then the associated backlight requirements of bin i, must be preserved and the backlight decision is therefore deduced from the index i.

In one embodiment, the perceived accumulated error function, E_sum[i], may take into account the number of pixels that would be compromised if the traversal were to continue to the next lowest power bin. Additionally, it may also include a multiplicative compound factor (typically greater than 1) to represent the non-linear escalation of perceived error as one traverses to lower backlight bins.

Referring back to FIG. 3B, and for merely exemplary exposition, it is seen that there are no pixels in either bin i=14 or i=15—so it is a safe bet that the DBLC may back the backlight power to at least digital value 232 (out of a possible 255 in this example) without any visual error induced. Now, starting with bin i=13, a small number of pixels sampled are requesting or requiring a level of backlight somewhere in that bin—somewhere between digital values 208 and 231 in this example. As is seen, the level of error is below the threshold, so the DBLC continues considering even lower backlight power possibilities. The DBLC continues in this fashion until bin i=10, when the error threshold has finally been exceeded. In one embodiment, a choice of backlight power may be selected at the right-hand side of bin i=10—which in this example is digital value 176. While this may be a "safe" choice in terms of error, it may be possible to be a little bit more aggressive in terms of power savings, as described below.

Once the error threshold has been exceeded, the DBLC may continue with further processing to determine a backlight value from within bin index i. Such additional processing may employ an additive fine_adjust_offset function which may be used in selecting only one of the backlight levels within the range of backlight values represented by that bin. In one embodiment, a fine_adjust_offset of zero would keep the backlight value at the lower bound of the range, and the maximum value of the fine_adjust_offset function adds a component that brings the backlight value up to the upper bound of the range.

```
E__sum[hist__size]=0
For i = hist__size−1 down to 0          (hist__size is total number of bins)
  E__sum[i] = (compound__factor * E__sum[i+1]) + hist[i]
          (compound factor may be greater than or equal to 1)
  If E__sum[i] >= TH1 then
    Backlight = i / (hist size) * maximum backlight value +
    fine__adjust__offset
```

Figure 4A:
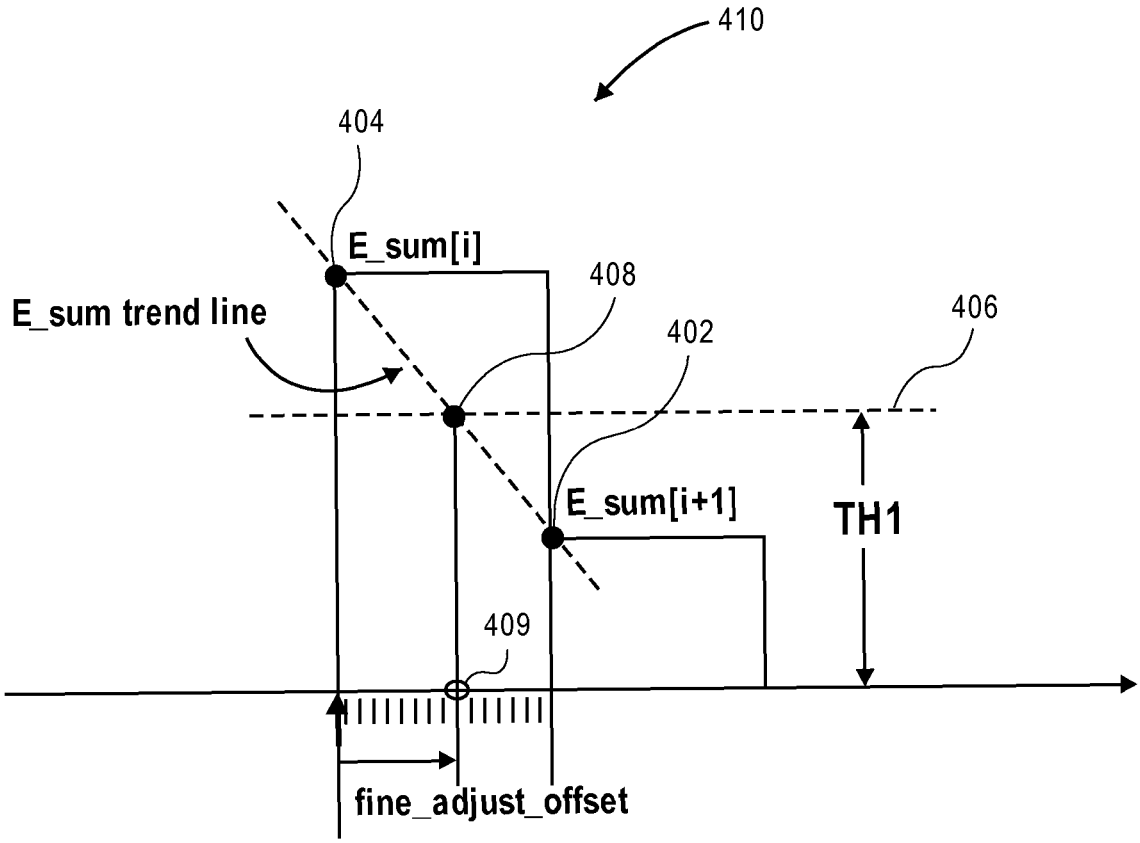
FIG. 4A shows one embodiment of additional processing to refine the setting of acceptable backlight power.

Assuming that E_sum[i] exceeds the threshold, TH1, and by inference the previous E_sum[i+1] in the reverse traversal (in the example above) did not exceed the threshold, then an E_sum trend line can be drawn from E_sum[i+1] to E_sum[i] as shown in FIG. 4A. The fine_adjust_offset theoretically matches the point where the E_Sum trend line crosses the threshold. The ideal fine_adjust_offset would therefore be computed as follows:

$$\text{fine_adjust_offset}=((E_\text{sum}[i]-TH1)/(E_\text{sum}[i]-E_\text{sum}[i+1]))*(\text{max backlight value/number of bins})$$

FIG. 4A depicts one embodiment of the processing of the fine adjustment offset. As may be seen, two lines—one line, as defined by lower edge points 404 and 409 of the two adjacent bin and a second line, as defined by the TH1 error threshold 406—may be solved simultaneously and the intercept point 408 may be dropped down to the x-axis to determine fine adjustment offset 409.

However many simplifications may be applied to make the fine_adjust_offset calculation easier in hardware as well as yield reasonable approximations of the ideal. One possible simplification may take the excess error defined by E_sum [i]-TH1 and compares it with a second threshold, TH2, which may be a power of 2. In this case a quotient is easily calculated and a fine_adjust_offset similar to the ideal is generated as follows:

$$\text{fine_adjust_offset}=((E_\text{sum}[i]-TH1)/TH2^{*}\ (\text{max backlight value/number of bins})$$

Figure 4B:
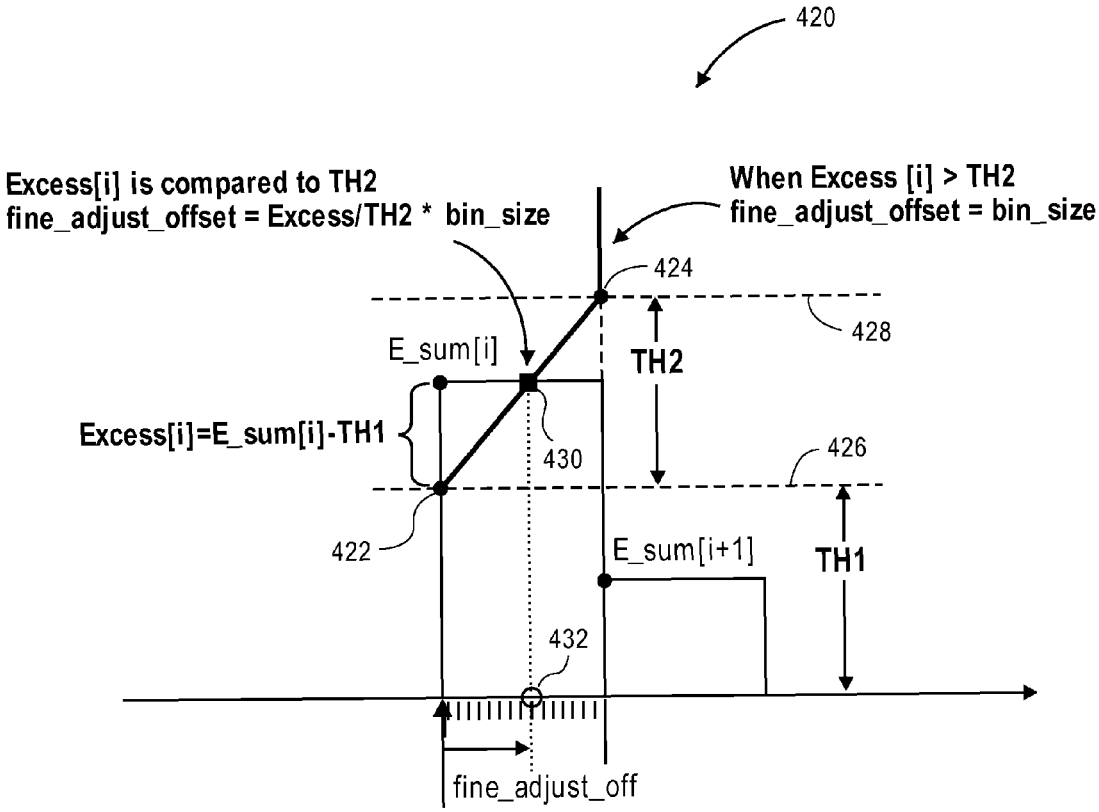
FIG. 4B shows another embodiment of additional processing to refine the setting of acceptable backlight power.

FIG. 4B depicts yet another embodiment of the processing of the fine adjustment offset. As may be seen, two lines—one line, as defined by edge points 422 and 424 of the two adjacent bin (as measured by two error thresholds TH1 and TH2) and a second line, as defined by the E_sum[i]—may be solved simultaneously and the intercept point 430 may be dropped down to the x-axis to determine fine adjustment offset 432.

Internal limits for the backlight allow a range from 25% to 100%. Within this range, the backlight decision may be further clamped to lower and upper bounds determined by MNBL and MXBL register settings. If the image is completely black (all zero data), then the minimum backlight setting is ignored and the DBLC backlight level will go to zero.

Backlight=max (Backlight, MNBL, 25%) or 0% if the image is completely black

Backlight=min (Backlight, MXBL, 100%)

Survey Module

Figure 5:
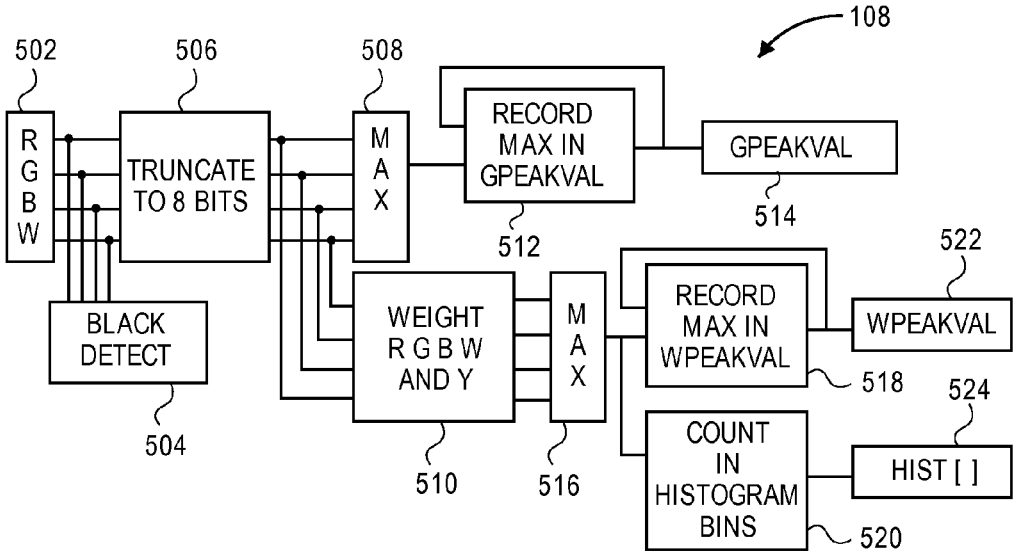
FIG. 5 is one embodiment of an image data survey module.

There will now be described some possible embodiments for processing blocks shown herein. For example, FIG. 5 depicts one embodiment of a survey module 108. Image data may be input in block 502—for example, RGBW (or other format). The RGB and W input values may be truncated (at 506) to their upper (e.g. 8) bits. These upper bits may include the Out Of Gamut (OOG) bit so that out-of-gamut values may still be represented. If global variable scaling is desired, the maximum of the truncated RGBW values may be calculated (at 508) for each pixel and the global maximum value is accumulated (at 512) in an 8 bit gpeakval register (at 514) for the whole image.

If the input values are truncated, the peak values may no longer be a reliable indication of a completely black image. It may be desirable to detect this (at 504)—for example, by OR'ing all the bits in all the primaries in all the pixels together or by any other manner. In the pseudocode below, the OR of the primaries of all the pixels in the image may be stored into an 11 bit register named black-detect and checks this for zero in the calc LED and gain module as described further below.

After truncation, the RGBW values may be individually scaled by separate color weights (at 510). In one embodiment, R is multiplied by 0.85, G by 0.70 B by 0.50 and W by 1.00. This may be efficiently done by multiplying each primary by a register value between 0 and 256 then right shifting the result 8 bits. The Yweight value weighs yellow values separately from the primary colors. This may be used as a modification of the red weighting value as a function of the green value. In this example, the primary values have all been truncated to 8 bits now and this may only require 8 bit calculations.

The maximum of the 4 RGBW primary values after weighting may be selected (at 516) for each pixel and then the maximum weighted primary for the whole frame may be accumulated in an 8 bit wpeakval register (at 516, 518 and 522).

The maximum of the weighted RGBW values may also be used to accumulate counts in a histogram (at 520 and 524). The maximum weighted RGBW value may be converted to an index by extracting the upper 4 bits. This may implement a histogram with 16 bins, although the lower 4 bins may not be implemented since we do not set the LED power below 25%. The bin indexed is incremented by one and clamped to a cutoff maximum.

The cutoff maximum might be a power-of-two (minus one). For example, if the counters in the histogram are limited to 14 bits, this cutoff would be 16K.

The following is pseudocode (in Lua code) that represents merely one exemplary survey module. The simulation allows setting the size of the histogram with hist-bits, the number of bits in the gamma pipeline with GAMBITS (currently 11), the number of bits in the weight values with SBITS (8) and the number of bits in the histogram counters with cutoff (14). These parameters may be fixed bit sizes in any particular implementation of the hardware:

```
function dohisto(x,y) -- scan one pixel and accumulate statistics
local r,g,b,w=spr.fetch(pipeline,x,y) --fetch the post GMA data
      --OR all the bits in all the primaries in all the pixels
black__detect = spr.bor(black__detect,r,g,b,w)
r = math.floor(r/(2^(GAMBITS+1−SBITS))) --hack out the upper
8 bits only
  g = math.floor(g/(2^(GAMBITS+1−SBITS)))
  b = math.floor(b/(2^(GAMBITS+1−SBITS)))
  w = math.floor(w/(2^(GAMBITS+1−SBITS)))
  local peak = math.max(r,g,b,w)
  gpeakval = math.max(gpeakval,peak)          --record global maximum
if weighted__color==1 then          -- weighting formula:
            --Rweight increases to affect yellow
    local Xweight = Rweight + ((Yweight−Rweight)*g/(2^SBITS))
    r = math.floor(r*Xweight/256)
    g = math.floor(g*Gweight/256)
    b = math.floor(b*Bweight/256)
    w = math.floor(w*Wweight/256)
  end
  local maxp = math.max(r,g,b,w)
  wpeakval = math.max(wpeakval,maxp)    --record weighted maximum
                  --build a histogram of maxp values
                  --upper hist__bits of maxp is index
  local i = math.floor(maxp/(2^(SBITS−hist__bits)))
  hist[i] = math.min(cutoff,hist[i] +1) --count them but clamp
end--function dohisto
```

Calc LED and Gain Module

Figure 6:
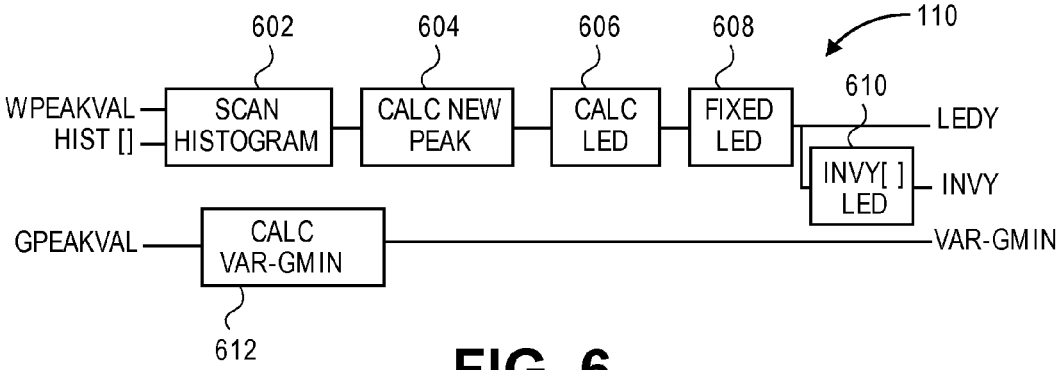
FIG. 6 is one embodiment of the Calc LED and gain module.

In this one exemplary embodiment, Calc LED and Gain module 110, as shown in FIG. 6, takes the statistics collected by the survey module during a frame and performs calculations during the vertical retrace time.

The histogram table is scanned (at 602) to calculate a modified peak value (at 604). The histogram bins are summed from the highest down until the sum exceeds a value called THH1. The sum may be compounded by multiplying its previous value by a small number near 1.0 on every cycle. A 3 bit fixed point fraction from the CMP register may be used to set this compounding factor. Three bits allows multiplying the previous sum by eight values between 1.0 and 1.875.

The counters in the histogram may have a fixed number of bits, typically 14 and thus may not count higher than (2^14)−1 or 16,383. When a histogram counter reaches this limit, it stops counting and always holds the maximum value. This maximum count is called 'cutoff' in the pseudo code implementations. The histogram threshold is a number between 0 and this cutoff. A THH1 value of 0 is conservative and will tend to choose a high backlight value. A larger THH1 value is more aggressive and will tend to choose a lower backlight value to save more power. A full bin may stop the search and set the power level.

Figure 7:
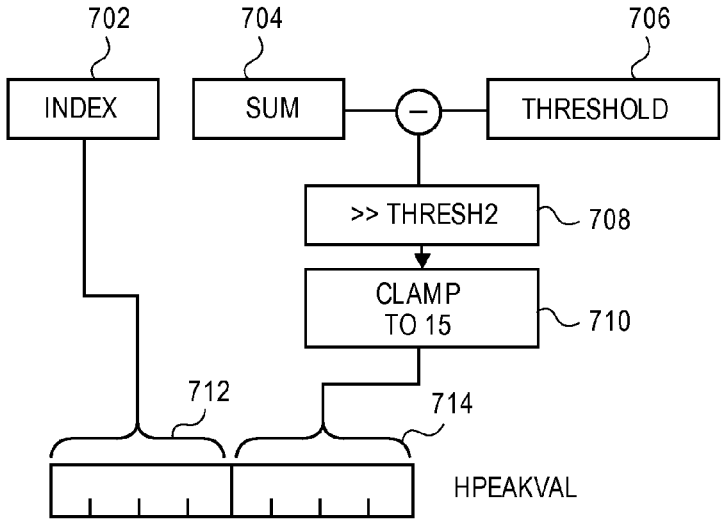
FIG. 7 is one embodiment of a module to create a histogram.

In one embodiment (of FIG. 7), the chosen histogram index (at 702) may be used to calculate a new peak value (as represented by 712 and 714). However, if just the histogram index was used, then only 16 (or whatever the hist-size may be) values may be chosen. The lower bits of the peak value may be constructed in the following way: when the search of the histogram stops, the sum (704) is always greater than the threshold (706). Subtracting the threshold from the sum will then produce a value between 1 and cutoff+1, perhaps more if the compound multiplier is large. The result of the subtraction is right shifted by a shift counter called THH2 (at 708). If the compound multiplier is 1.0 and THH1 is large, then a THH2 value of 10 bits will result in a 4 bit number which can be used to fill in the lower 4 bits of the new peakval. Some combinations of these settings can cause this value to overflow so the result of right shifting by THH2 must be clamped to a maximum value of 15 (0x0F) (at 710). In one embodiment, there may be some interaction between the values of THH1, THH2 and the compounding multiplier CMP. For example, as the value of the compounding multiplier goes up or the value of THH1 goes down, the value of THH2 should go up (e.g. not higher than 12 or some other suitable value).

For alternative embodiments, it may be advantageous to use different threshold values for darker colors (e.g. THL) than those for brighter colors (e.g. THH). The variables THH1 and THH2 may be used when examining the histogram bins above the half way point. The variables THL1 and THL2 are used in the histogram bins below the half way point. The Lua code to implement this is part of the docalc function below.

In the case when the peak value size (SBITS) is equal to the size of the LED power settings (LEDBITS), the resulting peak value can be directly used as the LED power setting.

As an alternative embodiment, it has been desirable to have a method of forcing the LED power to a fixed value. This feature may be useful for hardware testing or to produce required power consumption levels.

If the LED power is below one quarter, it may be raised back up to the one quarter setting. When the image is black, as indicated by the black-detect bits from the survey module, the LED power may be forced to one.

```
function docalc( )          --Calculate LEDy and gain during vertical retrace
function docalc( )          --Calculate LEDy and gain during vertical retrace
  local hpeakval=wpeakval --default if hist_ena==0
  if hist_ena==1 then   --Use the histogram to decrease power farther
    local sum=0
    local hist_thresh1,hist_thresh2 = THH1*1024+63,2^(THH2+4)
    for i=HISTSIZE-1,0,-1 do
          --sum up the bins, compounding the previous ones
      sum=sum+math.floor(sum*(CMP+8)/8)+hist[i]
      if sum>=hist_thresh1 then        --if it crosses the threshold
                                --new peakval is index plus lower bits
        hpeakval = i*2^(SBITS-HISTBITS)        --index is upper bits
          --lower bits are built from the sum excess
      local lower = math.floor((sum-hist_thresh1)/hist_thresh2)
      lower = math.min((2^(SBITS-HISTBITS))-1,lower)
      hpeakval = hpeakval + lower
        break
      end --if the sum exceeds the threshold
      if i==(2^(HISTBITS-1)) then     --switch to the lower threshold
                                      values
        hist_thresh1,hist_thresh2 = THL1*1024+63,2^(THL2+4)
      end
```

-continued

```
    end --for all histogram bins, top to bottom
  end --end hist_ena
                        --convert peak value into LED power level
  LEDy = hpeakval                --the LED value is just the hpeakval
  LEDy = math.max(MNBL,LEDy) --clamp at 25% (default) power level
  LEDy = math.min(MXBL,LEDy) --and at maximum level
  if (black_detect==0) then      --use special black detector
    LEDy = 1                     --almost zero if the image is black
  end
  if DBLC==0 then       --allow forcing power to a fixed level
    LEDy = FXBL
  end
end -docalc
```

Decay Delay Module

Temporal artifacts may be visible when large changes in the backlight brightness and compensating LCD values occur. When a given portion of an image changes brightness or saturation, from one frame to another, such that it becomes desirable to change the backlight brightness, either brighter or lower, another portion of the image may not have changed. Thus, the change in backlight brightness may be accompanied by an opposite change in the LCD value. However, although the LCD is commanded to change instantaneously, the actual response of the liquid crystal material is slow to respond. This may create an optical lag condition that may create visible bright and dark "flashes". For example, consider when the backlight brightness goes from low to high, the LCD transmissivity command goes from high to low value to maintain the same color/brightness to the viewer. Similarly, when the backlight brightness goes from high to low, the LCD transmissivity command goes from low to high value to maintain the same color/brightness to the viewer. However, the LCD transmissivity actual response may be slow, typically exhibiting a near logarithmic asymptotic approach to the new LCD transmissivity command value. The difference in the LCD transmissivity actual response and backlight brightness may create temporary color/brightness error that may be visible.

Figure 8:
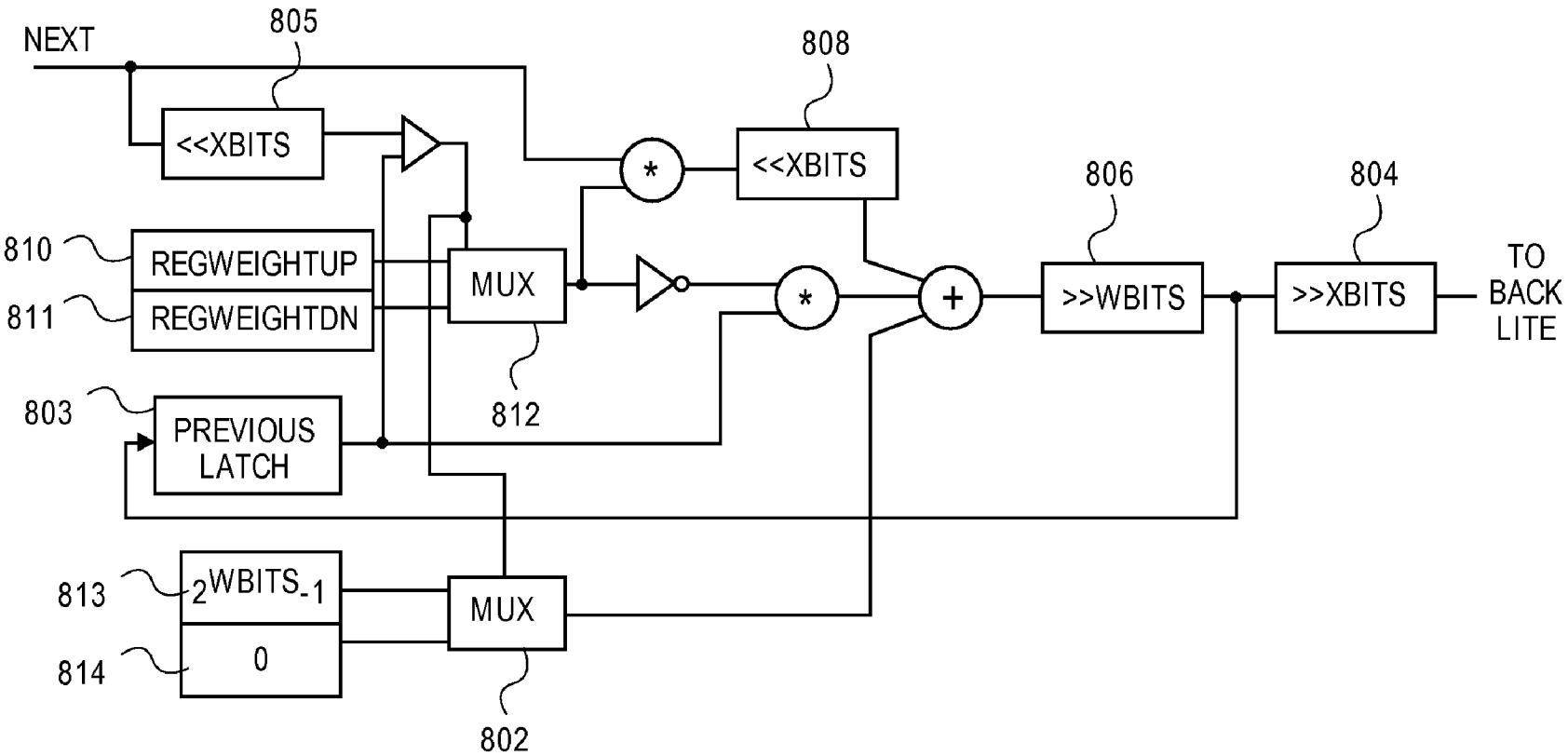
FIG. 8 is one embodiment of a decay delay module.
Figure 9:
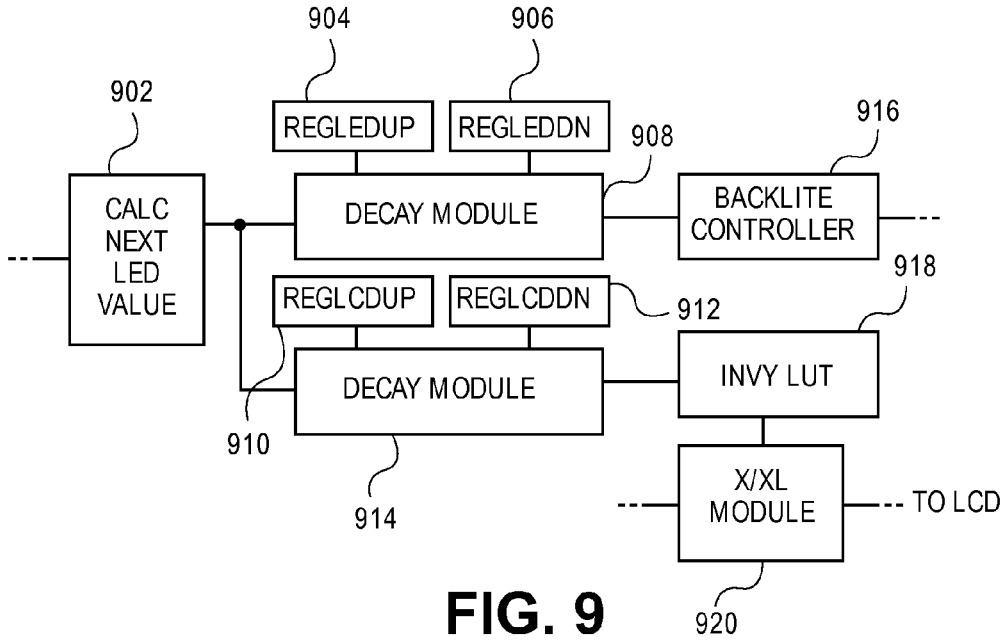
FIG. 9 is another embodiment of a decay delay module.

These visual effects were previously describes in co-owned PCT/US2007/069933 ('933 PCT application) which is incorporated herein by reference. FIGS. 8 and 9 of the present application were disclosed in that PCT reference as FIGS. 28 and 29 respectively.

A logarithmic decay algorithm is very simple, it takes a weighted average of the previous and the next value and replaces the previous value with the result. The simplest form of this is previous=(previous+next)/2 which will converge on a new value in a maximum of 8 steps when the difference between the previous and next is an 8 bit number. This is the "binary decay" formula because it moves half of the remaining distance at every step. A more general form is a weighted logarithmic decay: previous=(previous*(1−weight)+next*weight). If the weight value is one half, this is exactly the same as the previous formula. In an integer (hardware) environment you will have to represent the weight as a fixed point binary number. If the number of bits in the weight register is WBITS and WMUL=2WBITS then the formula would be:

$$\text{previous}=(\text{previous}*(WMUL-\text{weight})+\text{next}*\text{weight}+\text{round})/WMUL$$

(where weight is a value from 1 to WMUL. Weight=WMUL/2 is the binary decay case.)

The above formula has several problems when implemented in integer arithmetic. If the round variable has the value of zero then the formula never converges on a constant next value that is higher than the previous value. If the round variable is WMUL−1 then the formula does not converge on a constant next value that is lower than the previous value. The solution is to set the round value based on the difference between the previous and next values:

```
if next > previous then
   round = WMUL−1
else
   round = 0
end
```

If this test is done beforehand, then the formula converges correctly in either direction. In FIG. 8, the comparator (having inputs form 805 and 803) compares the next value with the output from the previous latch 803 and selects WMUL−1 when next is larger and zero when next is smaller. Another problem with the above formula is it cannot step in fractions of an LED power level, so the slope of the decay can never become less than 1.0. The solution to this is to add extra bits to the previous value that are stored from frame to frame but never sent to the LED backlight. If the number of bits is XBITS and XMUL=2XBITS then the formula becomes $$\text{previous}=(\text{previous}*(WMUL-\text{weight})+\text{next}*XMUL*\text{weight}+\text{round})/WMUL$$

Previous latch 803 may now be large enough to store the XBITS extra bits. Since the next value input does not have these bits, it may be modified by barrel shifter 805 before comparing it with the previous latch in the comparator. But the value output to the LED backlight controller is now:

$$\text{previous}>>XBITS$$

Next, an additional test to compare next>previous may be done, which may be done as (next<<XBITS)>previous now.

It is possible that increasing XBITS by one adds about 5 frame times to a response to a large change with a small weight. When weight=2 out of 15, XBITS=0, decaying from 0 to 127 takes around 26 frame times. If XBITS=4 then the decay takes 46 frame times.

Note that there are many optimizations in the above formula. Dividing by WMUL is a right shift (at 806), of course. The two multiplies may be (LEDBITS+XBITS)*WBITS in size, but since the lower bits of next*XMUL may be zero, this multipler may only be (LEDBITS)*WBITS in size followed by a left shift. The value (WMUL−weight) can be easily calculated by inverting every bit in the weight value.

If gate count is an issue, the number of bits in the weight value can be reduced. This only decreases the number of different decay rates that we have to choose from. For example, if the weight value only has 4 bits, then there will be only 16 weight values to choose from, the round value will be set to 15 for converging up, and the multipliers would only have to multiply by 4 bit values and discard 4 bits afterwards. Note that this has no effect on the slope of the decay, only XBITS has an effect there.

Because LCD shutters converge to a new value at different rates when going up than when going down, it may be possible to have two separate registers to contain the decay rate for increasing separate from decreasing (e.g. 810 and 811). Since the round value is already being calculated based on the direction of the change, the weight value can be selected from two different registers based on the same test result.

There may be two reasons for decaying any changes in the backlight value. One is to reduce flicker when the input image is changing rapidly. Another is to compensate for the slow response of LCD shutters when they are changed by large amounts. To implement both, FIG. 9 shows one possible embodiment of a decay delay module that contains two separate decay modules 908 and 914, each identical to the one described above. The LED power level is calculated in CALC module 902 and sent to both decay modules 908 and 914. Each decay module may have its own settable registers 904, 906 and 910, 912 respectively for the up and down decay. The output from one of the decay modules may go to Backlight Control 916. The output from the second decay module, after being inverted by INV LUT 918, may go to the X/Xl module 918 to effect the rest of the LCD path of the system. Note that both of the decay modules are decaying LED power values, which tend to have fewer bits than the INVy LUT values described above or the values in the gamma pipeline. It is possible to invert the output of the second decay module for use in the X/Xl module.

As was further described in the '933 PCT application, X/Xl may act as a normalization function. For one merely example for a RGB to RGBW display system, input image RGB data is first modified by the relationship between the brightness of each incoming RGB value after input gamma function and the actual amount of RGB light available at that given pixel from backlight array, as provided by a backlight interpolation function. This modification is accomplished in X/XL function by the ratio, X/XL, where X is the incoming value of R, G, or B. and XL is the backlight brightness value at that pixel of RL, GL, or BL. Thus, a given RGB to RGBW gamut mapping algorithm may have the input value R/RL, G/GL, B/BL.

Figure 10:
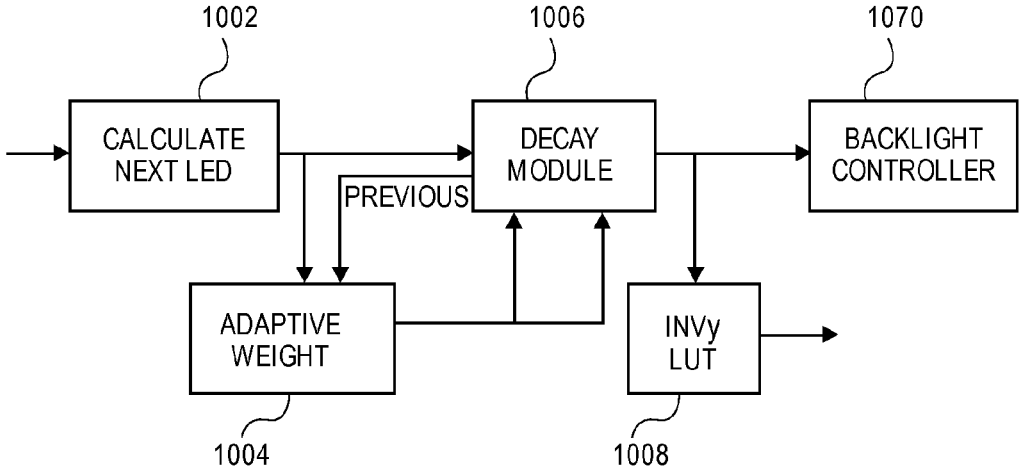
FIG. 10 is yet another embodiment of a decay delay module

Despite all the flexibility of this design, it still may be desirable to have different decay rates for different applications. For example, a slide show may require a rapid decay rates while a movie requires a slow decay rate. The decay rate could be changed if the system is informed what the display is being used for but this information is not always communicated. Another possible solution is to use is an adaptive transition rate, as shown in FIG. 10. Adaptive weights may be calculated in 1004. The transition rate is calculated from the difference between the backlight of the previous and next LCD power rates.

$$\text{weight}=\text{math.floor}(\text{math.}abs(\text{next}-\text{previous}/XMUL)/(2\hat{}(\text{LEDBITS}-W\text{BITS})))+1$$

The weight calculation above may take the absolute value of the difference between the previous and next LED value. It may be possible to use just the upper bits of the result. One may be added so that a zero weight may not be chosen which might prevent convergence on a new LED setting. The resulting weight is currently used for the up/down weights on both the LED and LED decay modules. This may greatly decrease the number of gates in the whole delay/decay module and simplifies it to the architecture of FIG. 10.

Once the LED power has the decayed value, it may be inverted to create a multiplier for the X/Xl module. This may be done in an inverse LUT calculated beforehand. Since the first quarter of the values may be fixed values, some savings of hardware may be realized by doing them as a special case and making the LUT smaller. When the LED power is zero, the inverse value may be zero. For the quarter power values, the inverse value may be:

$$INVy=\text{math.floor}(\text{LEDMAX}*INVMUL/((\text{LEDquart}+1)*2))$$

When LEDMAX=255, INVMUL=256 and LEDquart=63 then INVy=510 (although 511 is also reasonable). For the rest of the inverse table the values may be:

$$\text{Over}XL[\text{LED}y]=\text{math.floor}(\text{LEDMAX}*INVMUL/(\text{LED}y*2))$$

Where LEDy is the LED power level, typically between 64 and 255. It may be noticed that these are values between 510 and 128. The upper bit may always be on and this could allow a decrease in the size of the table.

The global peak value may be used to calculate the variable gmin value for the post-scale module. First it may be possible to predict how far the image will be OOG after the X/Xl scaling. This may be done by multiplying gpeakval by INVy (and right shifting 8) and store this value in vpeakval.

If vpeakval value is greater than SMAX (127 with 8 bit LED settings), then some of the pixels in the image may be OOG and the lower bits of the calculation indicate how far the farthest went OOG. This value may be linearly interpolated to produce a var gain value between 256 (a prescale of 1.0) and 128 (a prescale of ½). The result mey be used by the post scaler to multiply saturated colors by a value between 1 and ½ to bring them mostly back into gamut.

In one embodiment, the post-scaler may not bring all the colors back into gamut if the gmin values are calculated linearly. This may give the correct answer for fully saturated colors and the correct answer for the edge of the desaturated colors, but may scale by a slightly high value for colors between. One embodiment might use a "correct" formula but it requires a division, or a look-up-table and a multiply. However, other embodiments may use lower cost approximations. The first line below is the current linear formula for calculating var_gmin, the second line below represents the "correct" formula.

$$var_gmin=256-\text{math.floor}(128*(vpeakval-SMAX-1)/(SMAX+1))$$

$$var_gmin=\text{math.floor}(255*(SMAX+1)/vpeakval)$$

Since this may use fewer gates, this may be desirable. This may leave some colors OOG but these OOG colors may be caught in the end by the gamut clamping module which could be an optional part of the post-scaler.

Post Scale Module

In some embodiments, it is possible to incorporate modules that involve scaling the values by different amounts. For example, a saturation-based pre-scaler may scale the saturated colors down to keep them in gamut. The X/XL module in a DBLC design scales the pixel values up or down by a value related to the backlight intensity. A GMA often incorporates a gamut clamper module that scales the out-of-gamut colors down. Each of these modules may multiply the 3 or 4 pixel primary values by a scale factor. The pixel values are typically fairly large, 11 or 12 bits wide. The scale factors are typically a little smaller at 8 or 9 bits. In a display that has a separate pre-scaler, an X/XL module and a gamut clamper, each of these steps may use many gates to implement the multipliers.

The present Post Scaler may replace all of these large multipliers by one set at the end. The scale factors are combined into a single scale factor and only one large multiplier per primary is needed in the post scaler. Combining the scale factors together may also require multipliers, but these may be smaller 8×8 bit multipliers and these calculations are only done once per pixel instead of once per primary in every pixel. Also, optimizations can remove some of these scale factor multiplies and replace them with simple comparisons.

Figure 11:
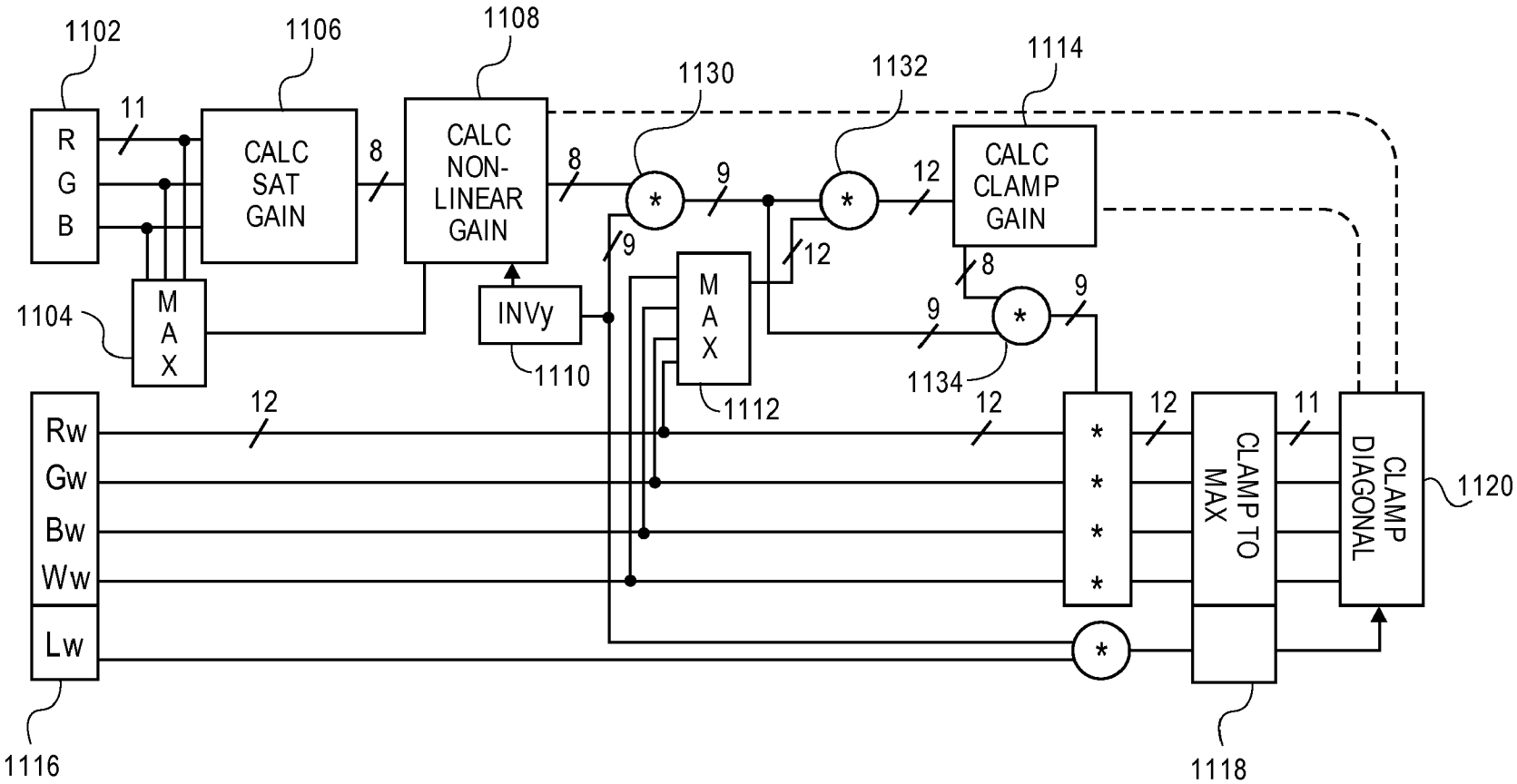
FIG. 11 is one embodiment of a post-scaler.

There are possible may various embodiments of the Post Scaler with some optimizations that allow replacing some of the multipliers with simple minimum functions. These optimizations may work, for example, for bright images that were being scaled down. For very aggressive modes and dark images that are scaled up during X/XL, other different optimizations may be possible. For example, FIG. 11B shows one embodiment that uses fewer multiplers and a minimum function to perform substantially the same operations as FIG. 11.

In one embodiment, some of these optimizations may be made in accordance with a few assumptions. For example, one assumption might be not to use backlight settings below 50%. Another assumption might be to not use aggressive modes on images below 50%. Yet another assumption might be to use hard clamping and to accept hue error on dark images.

In one embodiment, as described below, it may be possible to have better performance on dark colors. Consider all the gain terms (except non-linear) as being scale factors near one. Multiplying them all together produces a single scaling factor that does the same thing as multiplying the pixels by each term separately. Each of the multiplies below is typically divided by 256 afterwards to make the result a fixed point binary scale factor near one again.

Saturation based scaling is one response to OOG values. Currently, the saturation is calculated from the input RGB values after input gamma. The Calc Sat Gain module calculates the gain much the same way that previous pre-scale modules did. Such saturation based scaling was discussed in co-owned PCT/US2006/040272 (the '272 PCT application) and herein incorporated by reference.

Saturation Based Pre-Scaling

As discussed in the '272 PCT application, one embodiment of pre-reduction, the input RGB values may not be reduced by a fixed amount, but instead by an amount that is a function of saturation. Several different embodiments of functions of saturation may be adequate e.g. a function which has values near 1.0 when saturation is near zero has the advantage of mapping the input RGB white value approximately to the output RGBW white value. This may be advantageous over the pre-reduction algorithms above where the maximum possible white value may not be achieved. In another embodiment, the maximum value may be less than 1.0 to reduce simultaneous luminance contrast error. The functions of saturation may decrease to some percentage Pmax when saturation is at a maximum. If this Pmax value is larger than M2, the ratio of the brightness of W to the sum of the brightness of the R+G+B subpixels in the display, then there will be some OOG colors. Thus, a gamut clamping module as described above may still be desirable.

One possible curve for this saturation function is a Gaussian, but this may be computationally difficult to implement in hardware. A straight line may be adequate, and a piecewise linear function may also produce pleasing images. The values from this function are multiplied by the input RGB values. Thus, multiplying by 1.0 causes no reduction of the input values with low saturation and multiplying by Pmax or other fractions less than one will result in decreasing input values that have high saturation. AU these multiplications by fractional values may be implemented in hardware by multiplying by fixed point binary numbers followed by appropriate right shifts. Other means of implementing multiplication by shifts and adds are also included as part of the scope of the present invention.

Saturation may be considered the perpendicular distance away from the line of grays, typically scaled to range from 0 to 1.0 at the surface of the gamut. Although any number of calculations of saturation could be used, there are approximations to calculating this number which are well known in the industry, for example, $$\text{Saturation}=(\max(r,g,b)-\min(r,g,b))/\max(r,g,b)$$

The resulting saturation value may then used to generate one of the curves from FIG. 17. The piecewise linear line 1703, for example, with a Pmax value of 0.75 may be generated by the following equation: Pre_reduce=min(1,1-((Saturation−0.25)/(1-0.25))).

Then the input red green and blue values may be each multiplied by such a Pre_reduce value, as generated by any of the above embodiments:

$$R=R*\text{Pre_reduce}$$

$$G=G*\text{Pre_reduce and}$$

$$B=B*\text{Pre_reduce.}$$

Finally, these R, G and B values may be run through a GMA algorithm to convert RGB to RGBW.

In yet another embodiment, the pre-reduction function may also be made a function of hue. In an aforementioned patent application incorporated by reference, there is disclosed means of calculating a hue value that could be used for this purpose. Faces and other skin tones, for example, have a very narrow range of hue and it may be advantageous to use a different pre-reduction function on images with these features.

In yet another embodiment, the pre-reduction saturation function may also be made a function of brightness. So for a given saturation value, rather than using a constant scaling value, one would scale based on the proximity to BLACK. This would act like a gamma function, and it allows one to shift the output pixel distribution closer (or farther) to the RGBW gamut hull. It should also be appreciated that the pre-reduction function could be based as a function of some combination of hue, saturation and brightness.

In the discussion above, one embodiment might have only one pre-reduction function for all primaries. It may be desirable, however, to have a separate pre-reduction function for each (or a subset) of the input R G and B primaries. This could add the ability to do color correction or adjust the white point of the display. The white point may be changed independently of changes in mixed color points by changing the upper left end of curve (to reduce it from 1.0 to a lesser value) separately for red, green and blue.

Having separate controls or adjustment for the primaries as discussed above, allows for the adjustment of the chromaticity of mixed colors (e.g yellow, cyan, magenta, etc). For example, if red and green have separate Pmax controls and the green Pmax control is 25% lower than the red Pmax value, then the yellow color point will shifted towards the red primary color. Further, if the slope of the curve is made to be sufficiently steep near Pmax, then this change in yellow may be made without affecting the white point of the display.

A pre-reduction module may be placed between the input gamma and the Calc RwGwBw module. It is also possible to place pre-reduction in other places in the image processing system, such as before the input gamma module. Because the values before input gamma typically have a smaller bit-size, this may have the advantage of decreasing the gate count of hardware based on this design, hi addition, it is possible to combine the pre-reduction functions with the input gamma function, performing the gamma correction and the pre-reduction in one step. Because the input gamma function is often implemented as a look-up-table that is pre-calculated, it may then be possible to use superior algorithms, such as a Gaussian curve without paying a penalty in more complicated hardware.

Saturation Based Post-Scaling

One advantage of a post-scaling module over the old placement of the pre-scaling module is that a post-scaler may be able to use values calculated in other modules. The pre-scaler had a fixed GMIN scaling parameter stored in a register. This fixed value could be used to scale down the bright saturated colors in an image, but might not change its behavior when an image did not have any bright saturated colors. In the present embodiment, the survey module 108 in FIG. 5 calculates a GPEAKVAL 154 which records how bright the brightest saturated color is. In FIG. 6, the CALC VAR-GMIN module 612 calculates the minimum impact GMIN value that will just bring the brightest saturated colors into gamut. This VAR-GMIN value may modify images less than a fixed GMIN value. The VAR-GMIN value is used in the CALC SAT GAIN module 1106 in FIG. 11 in place of the fixed GMIN value. Alternately, a bit in a configuration register allows switching between the fixed GMIN and the VAR-GMIN value for some applications.

In one embodiment of a display system using such post-scaling, it may be desirable to employ this post-scaling unit for scaling image data values as a function of backlight illumination from said illumination determination unit, saturation of the image data values and out-of-gamut correction—with a single scaling factor. This single scaling factor may be a function of a number of scaling requirements as described herein. Some of these scaling requirements could be selected from a group scaling considerations, such as saturation based scaling, out-of-gamut scaling, and non-linear scaling. Of course, other scaling requirements may be desired and could be added as such. As further described herein, the non-linear scale module could be used to enhance dark color values and may depend on the luminance value of image data values. Once these scaling requirements are determined, there are a multitude of ways of combining them to create such a single scaling factor—including multiplying them or taking the minimum of them or a combination thereof.

As yet another embodiment, if some of the INVy calculations are done earlier in the pipeline, then the multiplier 1130 of FIG. 11 may be replaced with a simple Minimum function that passes the smaller of the INVy or the non-linear gain value. When the DBLC does not allow the brightness of the display to go below 50%, then INVy value may not be larger than 8 bits and multipliers 1132 and 1134 may also be replaced with simple Minimum functions.

It should be noted that the saturation can be calculated any time after input gamma so this calculation may be done in parallel with the GMA and survey processing. The SPR module may later need a single saturation threshold bit so it makes sense to calculate this bit from the saturation calculated in the Calc Sat Gain module 1106 in FIG. 11. In one embodiment, this module may calculate 1/saturation so that a low value is more saturated than a high one. If this inverse saturation is below a sat_thresh register setting, then the sat threshold bit is 1, otherwise it is zero.

The Calc Non-Linear Gain module 1108 adds a term back to the saturation gain that is based on the maximum of the RGB values after input gamma. This term is too large for dark images and effectively disables the saturation scaling. It is possible to set a test to disable non-linear gain when INVy<255 (with input from 1110).

If the backlight level is reduced below 100%, then in one embodiment the same luminance may be maintained by amplifying the light valves proportionately by the inverse of the backlight level. However in the case of aggressive backlight decisions, the scale value may over-amplify the light-valves and they would exceed the valid range of operation. Clipping or clamping (at 1114, 118 and 1120) would ensue and the image would loose any bright grey-level gradients present in the image. Non-linear gain aims to non-linearly adjust the scale value of pixels such that dark pixels are amplified by the inverse of the backlight decision and brighter pixels are amplified by decreasingly lower scale values such that the resulting light valve values do not exceed the valid range of operation thereby preserving more bright gradient information than the brute force approach.

The sat-non-linear gain may be combined with the X/Xl scaling factor by multiplying them together (and right shifing 8). The INVy value may be a number greater than or less than 1.0 so it is stored in a 9 bit fixed point value with 8 bits below the binary point. The saturation gain is a value between 128 and 256 so it is sometimes 9 bits.

Aggressive LED power calculations and saturation-based scaling options may still result in OOG values. So gamut clamping (at 1118, 1120) may still be accomplished. The OOG value after sat and X/XL scaling is estimated by multiplying the max of RwGwBwWw by the combined sat and X/XL gain. If the upper bit of the result is on, then the color is OOG and must be clamped. The lower 11 bits of the maximum is the distance OOG and can be used as the index into a LUT containing a clamp scaling value as we have done in previous designs. The resulting clamp_gain may then be combined with the other scaling factors by multiplying them together again.

A final combined gain term may be a 9 bit value with 8 bits below the binary point. This value may be multiplied by the RwGwBwWw values to scale them and bring them back into gamut with four 9*12=12 bit multipliers. There may be other embodiment and other several situations that may cause these values to be larger than 11 bits. One is quantization noise in the LUTs that can cause the values to be slightly larger than 11 bits. Another case is when M2>1.0. For these reasons it may be possible to detect if the upper bit (overflow) of the result of each product is on and clamp the final result to the maximum value that will fit in the lower bits.

The scaling multipliers moves a color towards black, performing scale or "clamp to black". This tends to lower the luminance of a pixel but preserves hue and saturation. To clamp to the line of grays (clamp to luma) or to some angle between (clamp diagonal), it is possible to use an algorithm that adds the missing luminance back in the W values. This may use the luminance value, but the luminance value from the GMA Module may no longer be valid. In some cases, the luminance value may not be re-calculated from the RwGwBwWw values if they are OOG and result in an OOG luminance value. One possible solution may be to multiply the luminance by the INVy value to bring it into the same range as the RwGwBwWw values again. This may be done with 9*12=12 bit multiplier. Once there is a valid luminance value, the diagonal clamping module may use it to calculate the amount to add to W as discussed in previous applications. An alternate embodiment would be to multiply the luminance by one of the intermediate products, for example the product after multiplying the non-linear gain by the INVy value.

However, while it may be desired to only performed diagonal clamping on values scaled by the gamut clamping module, it may be possible to save a signal from the Calc Clamp Gain module that indicates if the final gain includes clamping. This is true if the clamp_gain is less than 256 (if the upper bit is off). The diagonal clamping module may then be bypassed when there is no clamping gain.

Also, it is possible to do diagonal clamping on saturation scaling. In an alternative embodiment, a new register bit may enable this, allowing the diagonal clamping module to work on colors scaled for either reason. This processing may be done when the result of the calc-non-linear gain module is <256 (upper bit off). The two dashed lines in FIG. 11 show these signals coming from the saturation/non-linear and gamut clamping modules to enable or disable the clamp diagonal module under these conditions.

The input gamma table converts 8 bit RGB values into 11 bit linear values in one embodiment. The GMA module converts these into 12 bit RwGwBwWw values that may be as much as 2 times OOG. The result of the Post-Scale module is RwGwBw values that have been scaled and clamped into 11 bit values again. The following pseudo code that performs these functions of the Post Scale Module is listed below:

```
function dopost(x,y)
  local sat__gain=256 --I start by calculating saturation gain
  local scale__sat = 0            --flag indicating what scaling was done
  local scale__clamp = 0
            --Perform saturation-scale gain calc
  if sat__scale==1 then
    local gmin=GMIN+1             --default to fixed GMIN
    if VGE==1 then    --perform variable post-scaling
      gmin = var__gmin        --if requested, use calculated gmin
    end
      --satuation calculated from RGB just after input gamma
    local r,g,b = spr.fetch(ingam,x,y)
    local max__rgb = math.max(1,r,g,b)
    local min__rgb = math.min(r,g,b)
--inv__max__rgb is aLUT in hardware versions
    local inv__max__rgb__lut = math.floor((plus4bit/max__rgb)+0.5)
    local sinv = math.floor(inv__max__rgb__lut*min__rgb)
    sat__gain = math.floor(REG__SLOPE*sinv/plus4bit+gmin)
    sat__gain = math.min(256,sat__gain,GMAX+1)
      --turn saturation into an 4bit number for thresholding
    sinv = math.floor(16*sinv/plus4bit)
--if this is a saturated pixel
    if sinv<(STH+1) and not (math.max(r,g,b)==0) then
      sinv=1                          --set the threshold bit
    else
      sinv=0
    end
    spr.store("sinv",x,y,sinv)    --save this for the SPR module
    nl__gain = sat__gain
          --Tony's non-linear gain term
```

-continued

```
        if INVy<256 then                    --does not work on dark images
          local nl__off = math.floor((N*16+16)*(MAXCOL−
                                        math.max(r,g,b))/(MAXCOL+1))
          nl__gain=math.min(256,sat__gain+nl__off)
        end
      if sat__gain<256 then
        scale__sat = 1                --record that sat gain was dominant
      end
   end    --END OF saturation-SCALING
        --combine the X/Xl scaling with the saturation based scaling
   XS__gain = math.floor(nl__gain*INVy/256)
              --fetch the values after GMA
   local Rw,Gw,Bw,Ww,Lw,Ow=spr.fetch(pipeline,x,y)
              --always calculte the Gamut Clamp gain and
-- use that if other algorithms leave a color OOG
local maxp = math.max(Rw,Gw,Bw,Ww)        --find the maximum primary
                    --predict how far OOG after sat and X/XL
   maxp = math.floor(maxp*XS__gain/256)
   local clamp__gain=256                          --default to 1.0, no clamping
   if maxp>MAXCOL then                            --if this color would go OOG
      local Ow = spr.band(maxp,MAXCOL)            --calc distance OOG
                        --results of the INV LUT for gamma claming
      clamp__gain = math.floor((256*(MAXCOL+1))/(maxp+1
      rd = OutGamma((256-clamp__gain)*MAXCOL*2/256) ))
      if clamp__gain<256 then
        scale__clamp=1            --if gain is still needed, set flag bit
      end
   end -- out of gamut color
                    --combine X/XL, sat and clamping to one constant
   XSC__gain = math.floor(XS__gain*clamp__gain/256)
--the INVy X/Xl scaling value can be >1.0 so
--the scale value is 9bits now
              --with one bit above the binary point and 8 below.
   Rw = math.floor((Rw * XSC__gain+ 128)/256)    --12*9=12bit
Gw = math.floor((Gw * XSC__gain+ 128)/256)
   Bw = math.floor((Bw * XSC__gain+ 128)/256)
   Ww = math.floor((Ww * XSC__gain+ 128)/256)--clamp to black value for W
   Lw = math.floor((Lw * INVy + 128)/256) --X/Xl processing alone for L
   Rw=math.min(Rw,MAXCOL)        --hard clamp
   Gw=math.min(Gw,MAXCOL)        -- (happens if WR>1.0)
   Bw=math.min(Bw,MAXCOL)        -- and from quantization error in LUTs.
   Ww=math.min(Ww,MAXCOL)
   Lw=math.min(Lw,MAXCOL)
   spr.store("flags",x,y,bd,gd,rd)          --diagnostic image
              --*********************************
              --CLAMP diagonal options
   if CLE==1 and (scale__clamp or (scale__sat and sat__diag)) then
      local Wl    --calculate the W that produces the correct luminance
      Wl = math.floor((Lw*M1__inv-math.floor((2*Rw+5*Gw+Bw)*M2__inv/8))/32)
      Wl = math.min(Wl,MAXCOL)                --do not exceed the max!
--mix the two together
      Ww = math.floor((Wl*(2^(DIAG+4))+Ww*(128−(2^(DIAG+4))))/128)
   end --camp diag
spr.store("post",x,y,Rw,Gw,Bw,Ww,Lw,0)       --store them in output
        end--function dopost
```

Separate R G and B Post-Scaling

It may be noticed that while the pseudo code above only implements one GMIN and GMAX value, it is possible to have three separate GMIN and GMAX values for R G and B. There are many embodiments to implement such a system. One embodiment might be to build a 3-valued saturation scaler, but replace all three of the GMIN register values with the single var_gmin value when var_scale is enabled. Gamut clamping would also replace all three gain values. Another embodiment might be to calculate three separate peakvalues in the Survey Module for R G and B. The Calc LED and Gain Module may calculate three different var_gmin values, and the Delay Decay Module may process the three values. Then these three values would be available for separate gain calculations in the Post Scaler. Gamut clamping would still trump all three gain values, if it is desired to scale towards black with minimal hue change.

SPR

After clamping, processing may optionally proceed with SPR and as disclosed in many applications incorporated herein by reference. In one embodiment, it is possible to employ metamer-luminance sharpening. In another embodiment, it is possible to use mixed-saturation-sharpening in the display system. In mixed-saturation-sharpening, two sharpening filters may be used. When a pixel is near a saturated value, self-color-sharpening may be used. When a pixel is not near a saturated pixel, then metamer-luminance sharpening may be used. A saturation threshold bit calculated in the Calc Sat module may be used to determine if a pixel is saturated. To determine if a pixel is near a saturated one, the sat threshold bit may be stored in the SPR line buffers so that the surrounding orthogonal saturation values may be ORed with the saturation bit of the pixel. If the OR of these 5 bits is 1 then the pixel is near a saturated color. It is possible to store the sat threshold bit in the lower bit of the blue values in the SPR line buffers to conserve gates.

Output Gamma Dither Output Quantizer Module:

It may be desirable to have an LCD with a gamma of 1.0 so that the output gamma module may be greatly simplified. Instead of output gamma tables or gamma generators, the lower bits of the output values may be truncated or used for a final dither. In the example of an 11 bit pipeline, it is possible to truncate one bit, leaving 10 bits and use the next two bits for dithering an 8 bit result. This may use dither patterns that are better matched to particular repeating subpixel groupings that comprise the display—such novel subpixel groupings have been disclosed in may applications incorporated by reference herein. It is also possible to develop a three bit dither pattern and use all three of the lower bits for dithering.

In other embodiments, it is possible to use a dither table that has a separate bit for each sub pixel. In some tables, it is possible that both bits in each "logical pixel" may be on or off together. Thus, it may be possible that the table may be reduced to half the size by storing only one bit per logical pixel, or only one bit for every two subpixels. This may make the hardware easier to implement.

Figure 12:
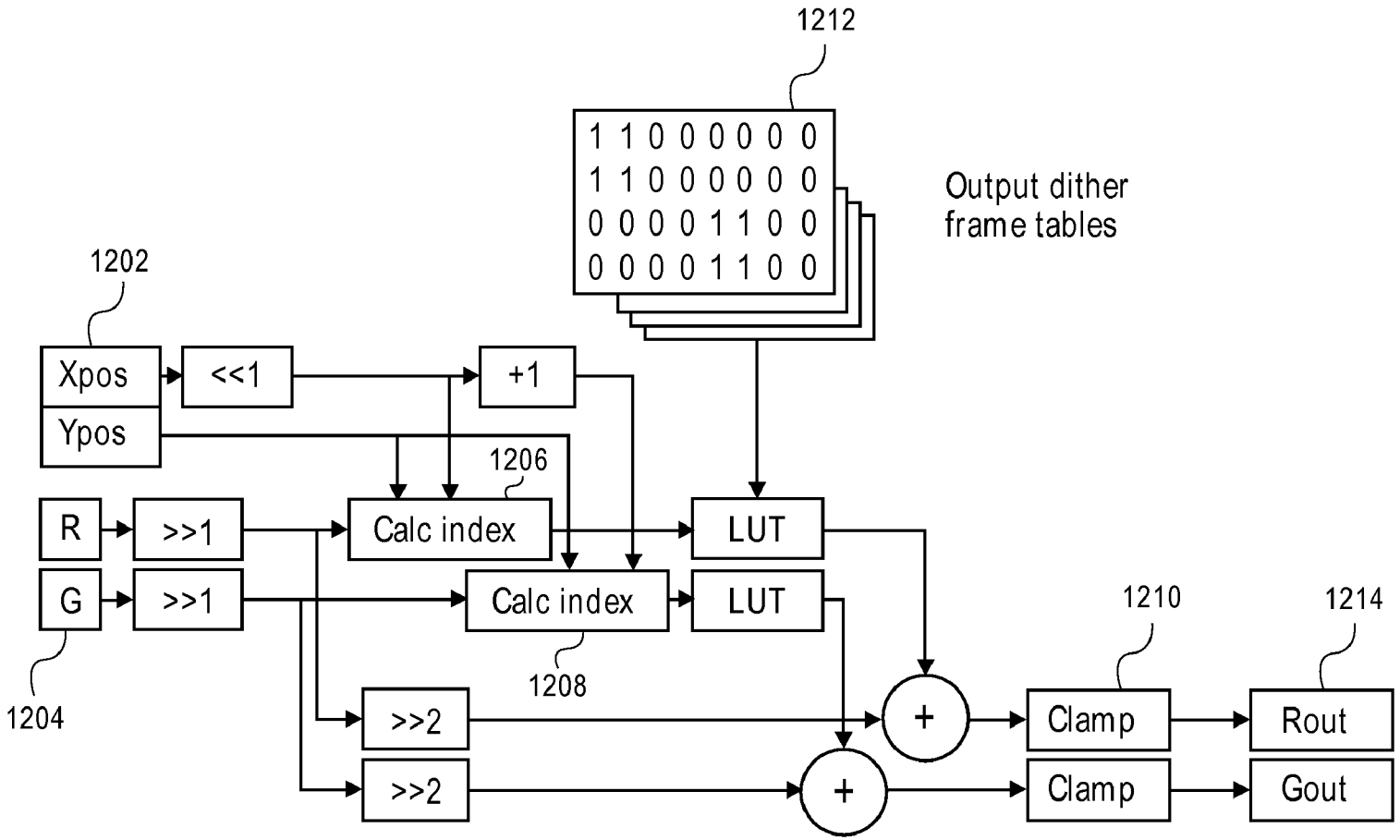
FIG. 12 is one embodiment of an output gamma dithering module.

Processing for an RG subpixel pair is shown in FIG. 12. The processing for BG may proceed likewise. The calculation for the index is just packing the lower bit of the logical pixel position (Xpos, Ypos) at 1202, an extra 0 or 1 bit for the R and G position, and two of the bits from either R or G. The R and G values may be ultimately shifted right by 3 converting an 11 bit value into an 8 bit value. The adders may have a bypass mode to disable dithering. The adders (or alternatively, incrementers) may occasionally cause an integer overflow and this may be detected and clamped to the maximum output value. The order of operations is not imperative—the shifts could be done by simply selecting and packing all the right bits together.

Although systems and methods of dynamic backlight control in a display system have been described with reference to the specific embodiments, they are not limited thereto. Therefore, it will be readily understood by those skilled in the art that various modifications and changes can be made thereto without departing from the spirit and scope of the present invention defined by the appended claims.

What is claimed is:

1. A method for dynamically controlling illumination of a backlight for a display system, said method comprising:

receiving image data that is to be rendered by said display system;

compiling said image data into a data structure according to information related to backlight illumination requests that are requested by said image data, said data structure dividing said image data into groups according to said backlight illumination requests, each group among said groups being associated with a visual error value and a backlight illumination request;

calculating values of an error measure by iteratively accumulating one or more visual error values associated with one or more additional groups among said groups at each iteration until having calculated a first value of said error measure that exceeds a first error threshold after a first visual error value associated with a first group among said groups has been added to a previous value for calculating said first value of said error measure, said previous value being less than said first error threshold;

determining a backlight illumination value using at least one of a first backlight illumination request associated with said first group and a second backlight illumination request associated with a second group among said groups, a second visual error value associated with said second group having been included in calculating said previous value; and employing said backlight illumination value in adjusting said backlight for said display system.

2. The method of claim 1 wherein said compiling said image data further comprises incrementing a counter for a set of histogram bins wherein further each histogram bin relates to a range of an amount of backlight illumination requested for each image data in said bin.

3. The method of claim 2 wherein said counter for each said histogram bin is limited to a capped amount.

4. The method of claim 3 wherein said capped amount is a percentage of the entire number of image data pixels within a frame of image data.

5. The method of claim 2 wherein said calculating said values of said error measure comprises including an amount associated with one histogram bin at a time starting with a bin requesting the most backlight illumination and progressing to bins requesting lesser backlight illuminations.

6. The method of claim 5 further comprising comparing said values of said error measure with said first error threshold, each of said values of said error measure being an accumulated amount of error values accumulated over one or more previous bins considered in one or more previous calculations.

7. The method of claim 6 wherein said determining said back light illumination value comprises employing a requested backlight illumination associated with a previous bin after a current bin that is currently considered adds an incremental amount of error to an accumulated value of said error measure that makes a resulted value of said error measure exceed said first error threshold.

8. The method of claim 7 wherein said method further comprises calculating a fine adjustment offset, said offset being associated with a function of requested backlight illuminations associated with the current bin and the previous bin.

9. The method of claim 8 further comprising using said fine adjustment offset to adjust said backlight illumination value.

10. The method of claim 7 wherein said fine adjustment offset is further a function of a second error threshold.

11. A display system comprising:

a frame buffer storing input image data;

a display for displaying said input image data;

a backlight for illuminating said display, said backlight comprises a set of illumination levels;

a data structure storing information corresponding said image data and backlight illumination requests associated with said image data, said data structure partitioning said image data into groups according to said backlight illumination requests, each group among said groups being associated with a visual error value and a backlight illumination request;

an error calculating unit for calculating values of an error measure by iteratively accumulating one or more visual error values associated one or more additional groups among said groups at each iteration until having calculated a first value of said error measure that exceeds a first error threshold after a first visual error value associated with a first group among said group has been added to a previous value for calculating said first value of said error measure, said previous value being less than said first error threshold;

an error comparison unit for comparing said values of said error measure with said first error threshold to identify said first value of said error measure; and a processing unit for determining a backlight illumination value using at least one of a first backlight illumination request associated with said first group and a second backlight illumination request associated with a second group among said groups, a second visual error value associated with said second group having been included in calculating said previous value, wherein said backlight illumination value is employed for adjusting said backlight.

12. The display system of claim 11 wherein said data structure further comprises a histogram comprising a set of bins, each said bins being associated with a requested backlight illumination.

13. The display system of claim 12 wherein said error calculating unit accumulates an error value for each histogram bin considered, starting with a bin requesting the most backlight first and considering other bins in descending order of amounts of backlight requested.

14. The display system of claim 13 wherein said backlight illumination value is determined as a function of both requested backlight illuminations of both current and previous bins considered.

15. The display system of claim 14 wherein said backlight illumination value is determined by as a function of said first error threshold and a second error threshold.

16. The method of claim 1 wherein said determining said back light illumination value comprises using said second backlight illumination request as said back light illumination value.

17. The method of claim 1 wherein said determining said back light illumination value comprises calculating said back light illumination value using both said first backlight illumination request and said second backlight illumination request.

* * * * *